US012498164B2

(12) United States Patent
You et al.

(10) Patent No.: US 12,498,164 B2
(45) Date of Patent: Dec. 16, 2025

(54) REFRIGERATOR

(71) Applicant: SAMSUNG ELECTRONICS CO., LTD., Suwon-si (KR)

(72) Inventors: Youngmin You, Suwon-si (KR); Jinyoung Song, Suwon-si (KR); Byungkwan Yang, Suwon-si (KR); Jaehyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 151 days.

(21) Appl. No.: 18/377,133

(22) Filed: Oct. 5, 2023

(65) Prior Publication Data

US 2024/0210091 A1 Jun. 27, 2024

Related U.S. Application Data

(63) Continuation of application No. PCT/KR2023/012702, filed on Aug. 28, 2023.

(30) Foreign Application Priority Data

Dec. 21, 2022 (KR) ..... 10-2022-0181115

(51) Int. Cl.
*F25D 17/06* (2006.01)
*F25D 11/02* (2006.01)
*F25D 23/06* (2006.01)

(52) U.S. Cl.
CPC ..... *F25D 17/065* (2013.01); *F25D 11/02* (2013.01); *F25D 23/066* (2013.01); (Continued)

(58) Field of Classification Search
CPC ..... F25D 23/066; F25D 11/02; F25D 17/065; F25D 17/04; F25D 17/06; F25D 17/08; (Continued)

(56) References Cited

U.S. PATENT DOCUMENTS 6,658,879 B2 12/2003 Park et al.
11,326,827 B2 5/2022 Heo et al.
(Continued)

FOREIGN PATENT DOCUMENTS

CN 114076450 A 2/2022
EP 4 174 410 B1 11/2024
(Continued)

OTHER PUBLICATIONS

International Search Report (PCT/ISA/210) issued on Dec. 18, 2023 by the International Searching Authority in International Patent Application No. PCT/KR2023/012702.
(Continued)

*Primary Examiner* — Ana M Vazquez
(74) *Attorney, Agent, or Firm* — Sughrue Mion, PLLC

(57) ABSTRACT

A refrigerator includes: an outer case; an inner case; an evaporator; a partition detachably mounted inside the inner case to define a refrigerating compartment and a freezing compartment below the refrigerating compartment; a cold air duct at the rear of the partition, the cold air duct being configured to guide cold air inside the inner case; and a cold air connector connected to the cold air duct from an outside of the inner case, the cold air connector being configured to deliver the cold air inside the refrigerating compartment to the evaporator. The cold air duct includes: a first discharge hole; a second discharge hole; and a return flow path extending from the refrigerating compartment to the cold air connector.

20 Claims, 24 Drawing Sheets

(52) U.S. Cl.
CPC ..... *F25D 2317/065* (2013.01); *F25D 2317/0666* (2013.01); *F25D 2317/0667* (2013.01)

(58) Field of Classification Search
CPC ..... F25D 23/06; F25D 17/045; F25D 17/062; F25D 23/069; F25D 2317/0671
See application file for complete search history.

(56) References Cited

U.S. PATENT DOCUMENTS

| | | | | |
|---|---|---|---|---|
| 2006/0130518 | A1* | 6/2006 | Kang | F25D 11/022 62/526 |
| 2015/0168048 | A1* | 6/2015 | Sexton | F25D 23/062 62/329 |
| 2017/0241696 | A1* | 8/2017 | Ma | F25D 21/12 |
| 2020/0200467 | A1 | 6/2020 | Park et al. | |
| 2020/0284493 | A1 | 9/2020 | Lee et al. | |
| 2023/0098256 | A1 | 3/2023 | Han et al. | |

FOREIGN PATENT DOCUMENTS

| | | | |
|---|---|---|---|
| JP | 2781428 | B2 | 5/1995 |
| JP | 7-305936 | A | 11/1995 |
| JP | 8-152246 | A | 6/1996 |
| JP | 10-332248 | A | 12/1998 |
| JP | 2020-101351 | A | 7/2020 |
| KR | 10-0451221 | B1 | 10/2004 |
| KR | 10-2011-0116437 | A | 10/2011 |
| KR | 10-2018-0039871 | A | 4/2018 |
| KR | 10-2020-0107390 | A | 9/2020 |
| KR | 10-2289303 | B1 | 8/2021 |
| KR | 10-2021-0158016 | A | 12/2021 |
| KR | 10-2335665 | B1 | 12/2021 |
| KR | 10-2022-0163653 | A | 12/2022 |

OTHER PUBLICATIONS

Written Opinion (PCT/ISA/237) issued on Dec. 18, 2023 by the International Searching Authority in International Patent Application No. PCT/KR2023/012702.

* cited by examiner

A
62
B
320
60
821
65
63
61
80
21(20)
C
C′
310
70
420
822
22(20)
+Z
+X
+Y
64
410
A′
B′

REFRIGERATOR

CROSS REFERENCE TO RELATED APPLICATIONS

This application is a by-pass continuation application of International Application No. PCT/KR2023/012702, filed on Aug. 28, 2023, which is based on and claims priority to Korean Patent Application No. 10-2022-0181115, filed on Dec. 21, 2022, in the Korean Intellectual Property Office, the disclosures of which are incorporated by reference herein in their entireties.

BACKGROUND

1. Field

The present disclosure relates to a refrigerator having an improved structure.

2. Description of Relate Art

A refrigerator is an apparatus that includes a main body having a storage compartment and a cold air supply system for supplying cold air to the storage compartment, thereby keeping foods fresh. The storage compartment include a refrigerating compartment that is kept at temperature of about 0 degrees Celsius to 5 degrees Celsius to keep foods refrigerated, and a freezing compartment that is kept at temperature of about 0 degrees Celsius to −30 degrees Celsius to keep foods frozen. In general, the front of the storage compartment is opened to allow foods to be put in and taken out, and the opened front of the storage compartment is opened and closed by a door.

A refrigerator repeats a cooling cycle in which a refrigerant is compressed, condensed, expanded, and evaporated using a compressor, condenser, expander, and evaporator. In this case, both the freezing compartment and the refrigerating compartment may be cooled by one evaporator provided on the freezing compartment side, and the freezing compartment and the refrigerating compartment may be respectively provided with evaporators to perform independent cooling.

Refrigerators may be classified into several categories depending on the shape of a storage compartment and door, and for example, may be classified into a top mounted freezer (TMF) category in which a freezing compartment is formed on an upper side and a refrigerating compartment is formed on a lower side and a bottom mounted freezer (BMF) category in which a refrigerating compartment is formed on an upper side and a freezing compartment is formed on a lower side, by partitioning the storage compartment vertically by a horizontal partition wall.

SUMMARY

Provided is a refrigerator having a cold air duct of an improved structure.

Further, provided is a refrigerator with improved aesthetics in the refrigerator.

Further, provided is a refrigerator capable of reducing the number of components.

Further, provided is a refrigerator with improved convenience of use.

Further, provided is a refrigerator in which one storage compartment may be implemented as a refrigerating compartment and/or a freezing compartment.

Further, provided is a refrigerator in which a ratio of a refrigerating compartment and a freezing compartment may be adjusted.

Technical tasks to be achieved in this document are not limited to the technical tasks mentioned above, and other technical tasks not mentioned will be clearly understood by those skilled in the art from the description below.

According to an aspect of the disclosure, a refrigerator may include: an outer case; an inner case; an evaporator; a partition detachably mounted inside the inner case to define a refrigerating compartment and a freezing compartment below the refrigerating compartment; a cold air duct at the rear of the partition, the cold air duct being configured to guide cold air inside the inner case; and a cold air connector connected to the cold air duct from an outside of the inner case, the cold air connector being configured to deliver the cold air inside the refrigerating compartment to the evaporator. The cold air duct may include: a first discharge hole communicating with the refrigerating compartment to supply the cold air cooled by the evaporator to the refrigerating compartment; a second discharge hole communicating with the freezing compartment to supply the cold air cooled by the evaporator to the freezing compartment; and a return flow path extending from the refrigerating compartment to the cold air connector and configured to guide the cold air inside the refrigerating compartment to the cold air connector, the return flow path having a first side configured to receive the cold air returned from the refrigerating compartment and a second side configured to supply the returned cold air to the cold air connector.

The cold air duct may further include a discharge flow path configured to guide the cold air cooled by the evaporator to the first discharge hole. The cold air duct may further include a wall separating the return flow path and the discharge flow path.

When the partition is separated from the inner case, the inside of the inner case may define the refrigerating compartment or the freezing compartment.

The cold air duct may be provided to form: a first return hole communicating with the refrigerating compartment to return the cold air inside the refrigerating compartment, the first return hole being positioned below the first discharge hole; and a second return hole communicating with the freezing compartment to return the cold air inside the freezing compartment, the second return hole being positioned below the second discharge hole.

The return flow path may be a first return flow path. The cold air duct may form a second return flow path configured to guide the cold air returned through the second return hole to the evaporator.

The partition may be between the first return hole and the second discharge hole.

The partition may be configured to be movable between the first return hole and the second discharge hole.

The cold air duct may extend along a height direction of the inner case. A first portion of the cold air duct may correspond to the refrigerating compartment. A second portion of the cold air duct may correspond to the freezing compartment.

The cold air duct may be configured to divide the inside of the inner case into (i) a storage space in which the refrigerating compartment and the freezing compartment are formed and (ii) a cold air generating space in which the evaporator is provided. The cold air generating space may be provided at a rear of at least a part of the storage space.

The cold air duct may include: a rear body configured to face a rear surface of the inner case; and a front body coupled to a front of the rear body, the front body being configured to be exposed toward the refrigerating compartment and the freezing compartment. The partition may be detachably mounted on a front surface of the front body.

The cold air duct may further include a support member between the front body and the rear body, the support member being configured to form the return flow path.

The refrigerator may further include: a door configured to open and close the refrigerating compartment and the freezing compartment together.

The refrigerator may further include an insulator between the inner case and the outer case. The cold air connector may be configured to be embedded in the insulator.

The cold air duct may further include: a first discharge flow path configured to guide the cold air cooled by the evaporator to the first discharge hole; and a second discharge flow path configured to guide the cold air cooled by the evaporator to the second discharge hole.

The refrigerator may further include: a fan configured to draw the cold air cooled by the evaporator and discharge the drawn cold air into the first discharge flow path and the second discharge flow path; a damper configured to open and close the first discharge flow path; a first temperature sensor configured to detect a temperature of the refrigerating compartment; a second temperature sensor configured to detect a temperature of the freezing compartment; and a controller configured to control the damper to open or close the first discharge flow path based on information obtained from at least one of the first temperature sensor or the second temperature sensor.

According to an aspect of the disclosure, a refrigerator may include: a main body forming a storage compartment, an evaporator in the storage compartment, a partition configured to divide the storage compartment into a refrigerating compartment and a freezing compartment that is positioned below the refrigerating compartment, the partition being provided in front of the evaporator, and a cold air duct extending between the evaporator and the partition along a height direction of the storage compartment, the cold air duct being configured to supply cold air cooled from the evaporator to the refrigerating compartment and the freezing compartment. The cold air duct may be provided to form: a first return hole communicating with the refrigerating compartment to return the cold air in the refrigerating compartment, a first return flow path having a shape extending rearward from the first return hole to guide the cold air introduced through the first return hole to the evaporator, a second return hole communicating with the freezing compartment to return the cold air in the freezing compartment, and a second return flow path having a shape extending rearward from the second return hole to guide the cold air introduced through the second return hole to the evaporator.

The partition may be detachably mounted to a front of the cold air duct.

The first return hole may be a plurality of first return holes arranged along the height direction of the storage compartment. The partition may be movable along the height direction of the storage compartment. The partition may be configured to be positioned below at least one of the plurality of first return holes. The refrigerator may further include a return hole cover configured to cover a first of the plurality of first return holes that is positioned below the partition.

The refrigerator may further include a fan in the cold air duct that is configured to generate a blowing force. The cold air duct may further include a discharge flow path extending from a discharge side of the fan to the refrigerating compartment to guide the cold air cooled from the evaporator to the refrigerating compartment. The cold air duct may further include a wall formed between the first return flow path and the discharge flow path to divide the first return flow path and the discharge flow path.

The discharge flow path may be a first discharge flow path. The cold air duct may further include a second discharge flow path extending from the discharge side of the fan to the freezing compartment to guide the cold air cooled from the evaporator to the freezing compartment.

According to one or more embodiments of the present disclosure, a refrigerator may have a cold air duct of an improved structure.

According to one or more embodiments of the present disclosure, a refrigerator may form an integral sense of aesthetics as one cold air duct for supplying cold air to a refrigerating compartment and/or a freezing compartment is provided at a rear portion of a storage compartment.

According to one or more embodiments of the present disclosure, because a refrigerator has an inner case forming one storage compartment, a component for dividing a refrigerating compartment inner case and a freezing compartment inner case may be omitted.

According to one or more embodiments of the present disclosure, a refrigerator may implement one storage compartment as a refrigerating compartment, a freezing compartment, or partitioned refrigerating and freezing compartments.

According to one or more embodiments of the present disclosure, a refrigerator may change a ratio of the refrigerating compartment and the freezing compartment.

According to one or more embodiments of the present disclosure, convenience of use of a refrigerator may be improved.

Effects obtainable from the present disclosure are not limited to the effects mentioned above, and other effects not mentioned will be clearly understood by those skilled in the art from the description below.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related elements.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other respect (e.g., importance or order).

When any (e.g., first) component is referred to as being "coupled" or "connected" to another (e.g., second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

The terms "front-rear direction," "front," "rear," "up-down direction," "height direction," "upper side," "lower side," "left-right direction," "left," and "right" used in the following description are defined with reference to the drawings, and the shape and position of each component are not limited by these terms.

Hereinafter, embodiments will be described in detail with reference to the accompanying drawings.

Figure 1:
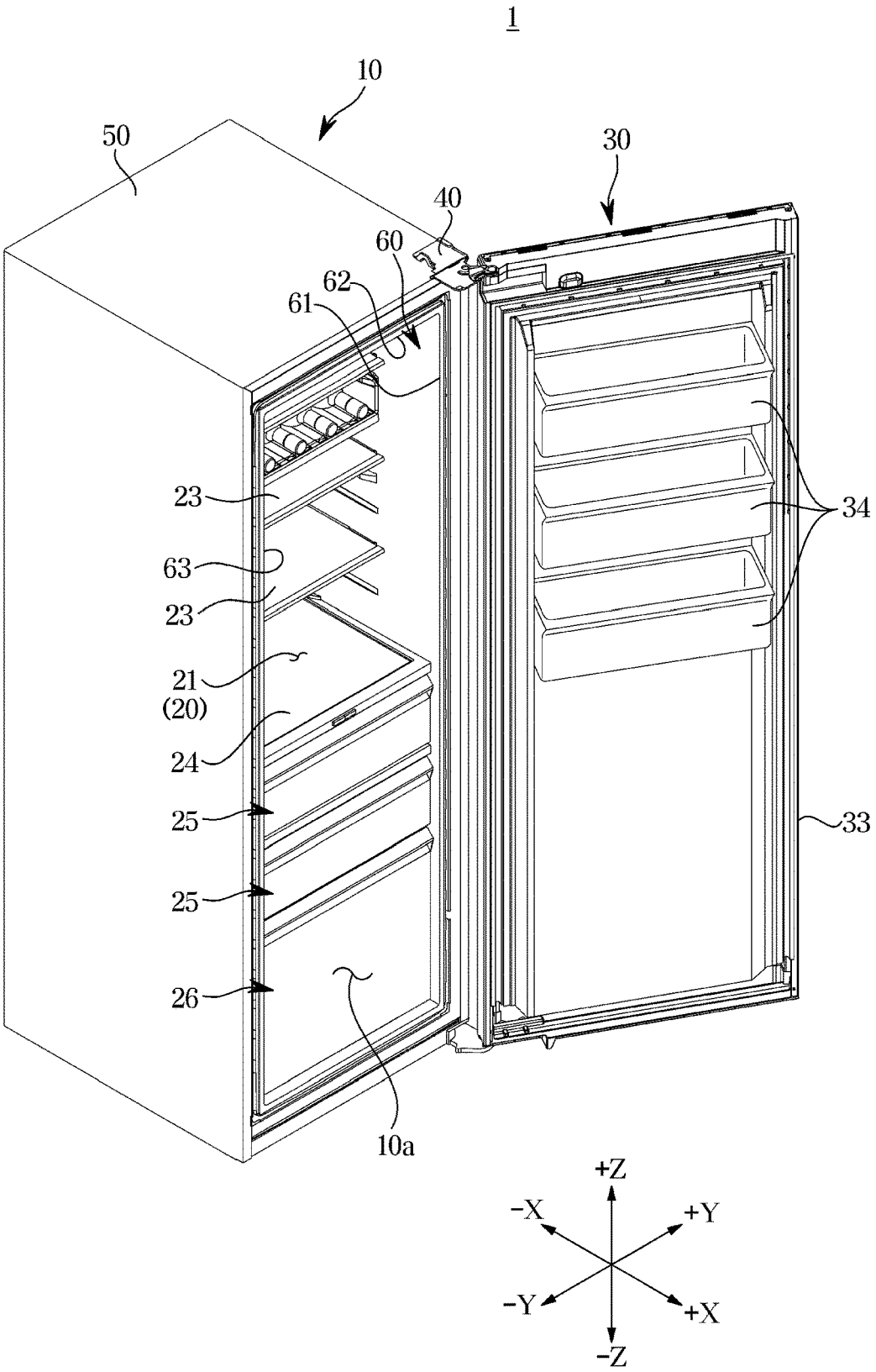
FIG. 1 is a perspective view of a refrigerator according to an embodiment.
Figure 2:
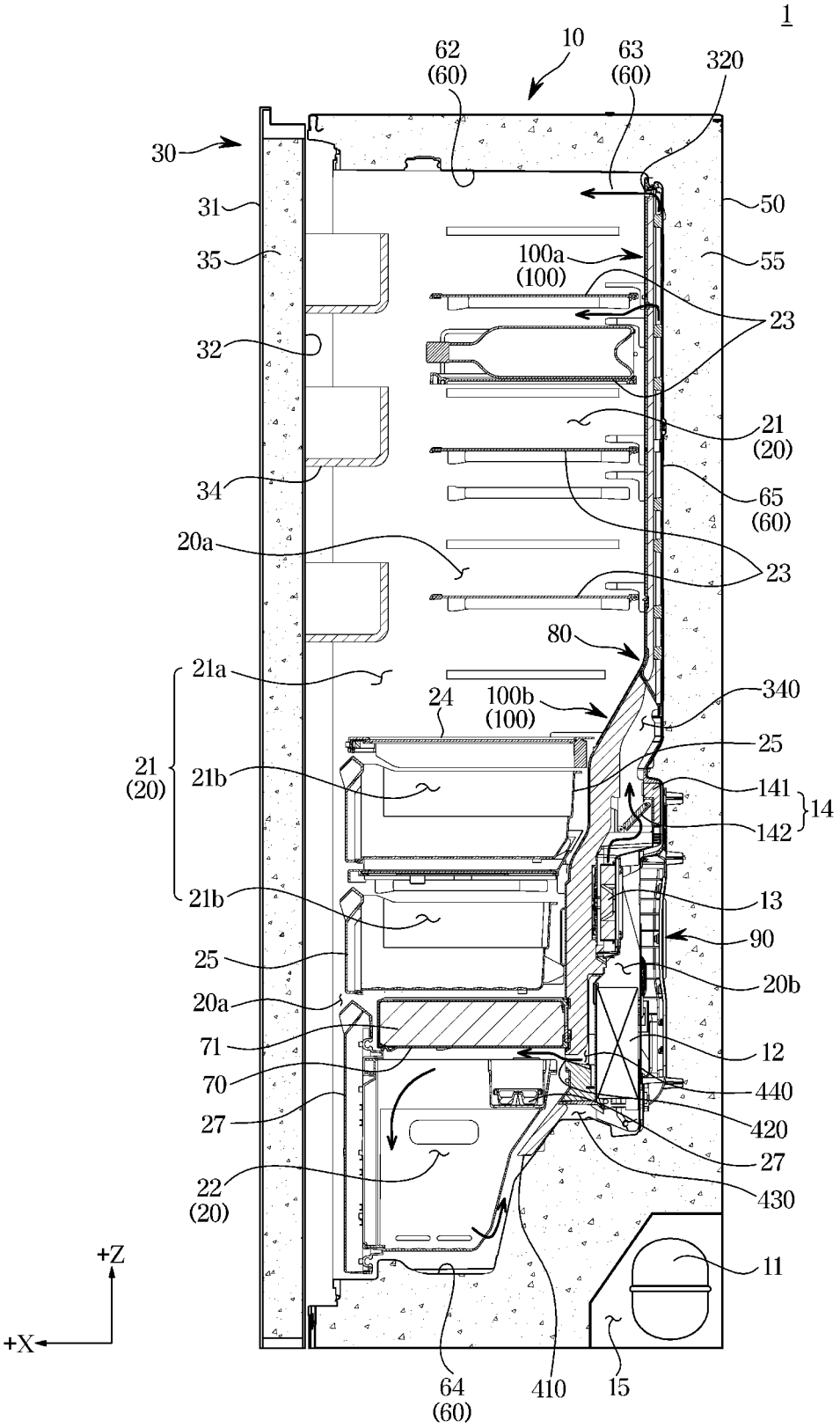
FIG. 2 is a side cross-sectional view of the refrigerator according to an embodiment.

FIG. 1 is a perspective view of a refrigerator according to an embodiment. FIG. 2 is a side cross-sectional view of the refrigerator according to an embodiment.

Referring to FIGS. 1 and 2, a refrigerator 1 may include a main body 10. The refrigerator 1 may include a storage compartment 20 provided inside the main body 10. The refrigerator 1 may include a door 30 provided to open or close the storage compartment 20. The refrigerator 1 may include a cooling system provided to supply cold air to the storage compartment 20.

The main body 10 may form at least a portion of an exterior of the refrigerator 1. The main body 10 may be formed such that the front thereof is opened so that a user may put foods in the storage compartment 20 and take the foods out. The main body 10 may include an opening **10*a*. The opening 10*a* of the main body 10 may be opened and closed by the door 30**.

The door 30 may be provided to open or close the main body 10. The door 30 may be provided to open or close the opening **10*a* of the main body 10. The door 30 may be rotatably coupled to the main body 10. For example, the door 30 may be rotatably coupled to the main body 10 by hinges 40 respectively connected to the door 30 and the main body 10**.

An outer surface 31 of the door 30 may form a portion of the exterior of the refrigerator 1. In a position where the door 30 is closed, the outer surface 31 of the door 30 may form a front surface of the door 30.

An inner surface 32 of the door 30 may be formed on a side opposite to the outer surface 31 of the door 30. In the position where the door 30 is closed, the inner surface 32 of the door 30 may form a rear surface of the door 30. In the position where the door 30 is closed, the inner surface 32 of the door 30 may be provided to face the inside of the main body 10. In the position where the door 30 is closed, the inner surface 32 of the door 30 may be provided to cover the front of the storage compartment 20.

The door 30 may include a door insulator 35. The door insulator 35 may be provided between the outer surface 31 of the door 30 and the inner surface 32 of the door 30. For example, a foaming space may be formed between the outer surface 31 of the door 30 and the inner surface 32 of the door 30, and the door insulator 35 may be foamed into the foaming space. The door insulator 35 may prevent heat exchange between the outer surface 31 and the inner surface 32 of the door 30. The door insulator 35 may improve insulation performance between the inside of the storage compartment 20 and the outside of the door 30.

For example, a urethane foam insulation, an expanded polystyrene insulation, and/or a vacuum insulation panel may be used as the door insulator 35. However, the embodiments are not limited thereto, and the door insulator 35 may include various materials to improve insulation performance between the storage compartment 20 and the door 30.

For example, the door insulator 35 may be made of the same material as a main body insulator 55, which will be described later. Unlike this, for example, the door insulator 35 may be made of a different material from the main body insulator 55.

The door 30 may include a door gasket 33. The door gasket 33 may be provided on the inner surface 32 of the door 30. The door gasket 33 may seal a gap between the door 30 and the main body 10 to prevent leakage of cold air from the storage compartment 20. The door gasket 33 may be formed along a circumference of the inner surface 32 of the door 30. The door gasket 33 may be disposed parallel to the opening 10*a* of the main body 10 when the door 30 is closed. The door gasket 33 may be configured to include an elastic material such as rubber. However, the embodiments are not limited thereto, and the door gasket 33 may include various materials to seal the gap between the door 30 and the main body 10.

The door 30 may include a door basket 34 capable of storing foods. The door basket 34 may be provided on the inner surface 32 of the door 30.

The door 30 may be provided as one door. The one door 30 may be provided to open or close an inner space of the main body 10 as a whole. The one door 30 may be provided to open or close the storage compartment 20 provided inside the body 10. As will be described later, the storage compartment 20 formed by an inner case 60 may be provided as a single space without being divided into a refrigerating compartment and a freezing compartment, and the door 30 may also be provided as one door. For example, even when the storage compartment 20 is divided into a first storage compartment 21 and a second storage compartment 22 by a partition 70, which will be described later, the one door 30 may be provided to open or close the first storage compartment 21 and the second storage compartment 22 together. That is, without a door for opening and closing the first storage compartment 21 and a door for opening and closing the second storage compartment 22, the first storage compartment 21 and the second storage compartment 22 may be opened and closed through the one door 30. Accordingly, the number of components (e.g., doors) of the refrigerator 1 may be reduced. In addition, manufacturing processes of the refrigerator 1 may be simplified, and a manufacturing cost of the refrigerator 1 may be reduced.

For example, the door 30 may close the first storage compartment 21 when closing the opening 10*a* of the main body 10. The door 30 may cover the front of the first storage compartment 21 when closing the opening 10*a* of the main body 10.

For example, the door 30 may close the second storage compartment 22 when closing the opening 10*a* of the main body 10. The door 30 may cover the front of the second storage compartment 22 when closing the opening 10*a* of the main body 10.

For example, the door 30 may cover the front of a first drawer 25, which will be described later, when closing the opening 10*a* of the main body 10. In a position where the first drawer 25 is retracted into a first lower storage compartment 21*b*, the front of the first drawer 25 may be covered by the door 30. However, the embodiments are not limited thereto, and the door 30 may directly close the first lower storage compartment 21*b*.

For example, the door 30 may cover the front of a second drawer 26, which will be described later, when closing the opening 10*a* of the main body 10. In a position where the second drawer 26 is retracted into the second storage compartment 22, the front of the second drawer 26 may be covered by the door 30. However, the embodiments are not limited thereto, and the door 30 may directly close the second storage compartment 22.

For example, the door 30 may cover the front of a first shelf 23, which will be described later, when closing the opening 10*a* of the main body 10. The entirety of the first shelf 23 may be disposed inside the main body 10, and the first shelf 23 may be covered by the door 30 in a state in which the opening 10*a* of the main body 10 is closed, so that an exterior of the first shelf 23 may not be exposed.

For example, the door 30 may cover the front of a second shelf 24, which will be described later, when closing the opening 10*a* of the main body 10. The entirety of the second shelf 24 may be disposed inside the main body 10, and the second shelf 24 may be covered by the door 30 in the state in which the opening 10*a* of the main body 10 is closed, so that an exterior of the second shelf 24 may not be exposed.

The main body 10 may include an outer case 50. The outer case 50 may form at least a portion of the exterior of the refrigerator 1. The outer case 50 may be provided on the outside of the inner case 60. The outer case 50 may be formed to have substantially the shape of a box with an open front. For example, the outer case 50 may form upper, lower, left, right, and rear surfaces of the refrigerator 1.

The outer case 50 may be configured to include a metal material. For example, the outer case 50 may be manufactured by processing a steel plate material.

The main body 10 may include the inner case 60. The inner case 60 may be provided inside the outer case 50. The inner case 60 may form the storage compartment 20. An inner space of the inner case 60 may be provided as the storage compartment 20. The inner case 60 may have a front open shape. The inner case 60 may be formed to have substantially the shape of a box with an open front.

The inner case 60 may include inner walls 61, 62, 63, 64, and 65.

For example, the inner case 60 may include the right wall 61, the upper wall 62, the left wall 63, the bottom wall 64, and the rear wall 65. For example, the right wall 61, the upper wall 62, the left wall 63, the bottom wall 64, and the rear wall 65 of the inner case 60 may form the storage compartment 20.

The inner case 60 may be configured to include a plastic material. For example, the inner case 60 may be manufactured by a vacuum forming process. For example, the inner case 60 may be manufactured by an injection molding process.

The main body 10 may include the main body insulator 55. The main body insulator 55 may be provided between the outer case 10 and the inner case 60. The main body insulator 55 may be provided to insulate the outer case 50 and the inner case 60 from each other. The main body insulator 55 may couple the outer case 50 and the inner case 60 to each other by being foamed between the outer case 50 and the inner case 60. The main body insulator 55 prevents heat exchange between the inside of the storage compartment 20 and the outside of the main body 10, thereby improving cooling efficiency of the storage compartment 20.

For example, a urethane foam insulation, an expanded polystyrene insulation, and/or a vacuum insulation panel may be used as the main body insulator 55. However, the embodiments are not limited thereto, and the main body insulator 55 may be configured to include various materials.

The main body 10 may include the storage compartment 20. The storage compartment 20 may be formed by the inner case 60. The storage compartment 20 may be provided as a single configuration. The storage compartment 20 may be provided as one space inside the inner case 60. For example, the inner case 60 may have substantially the shape of a box with an open front, and the storage compartment 20 may be formed therein.

The inner space of the inner case 60 may be partitioned in a plurality of spaces by the partition 70, which will be described later. The storage compartment 20 may be divided into a plurality of compartments by the partition 70. For example, the storage compartment 20 may be divided into the first storage compartment 21 and the second storage compartment 22 by the partition 70. A detailed description thereof will be given later.

The main body 10 may include the first storage compartment 21 and the second storage compartment 22. The first storage compartment 21 may be provided above the second storage compartment 22. The first storage compartment 21 may be disposed in an upward direction of the second storage compartment 22 (+Z direction). The second storage compartment 22 may be provided below the first storage compartment 21. The second storage compartment 22 may be disposed in a downward direction of the first storage compartment 21 (−Z direction).

The first storage compartment 21 and the second storage compartment 22 may be provided to have different temperatures. However, embodiments are not limited thereto, and the first storage compartment 21 and the second storage compartment 22 may be provided to have the same temperature as needed.

For example, the first storage compartment 21 may include a first upper storage compartment 21*a* and the first lower storage compartment 21*b*. The first upper storage compartment 21*a* may be provided above the first lower storage compartment 21*b*. The first upper storage compartment 21*a* may be disposed in an upward direction of the first lower storage compartment 21*b* (+Z direction). The first lower storage compartment 21*b* may be provided below the first upper storage compartment 21*a*. The first lower storage compartment 21*b* may be disposed in a downward direction of the first upper storage compartment 21*a* (−Z direction).

For example, the first shelf 23 on which foods may be placed, and/or a storage container on which foods may be stored may be provided in the first upper storage compartment 21*a*. One or more of the first shelves 23 may be provided. One or more of the storage containers may be provided.

For example, the first drawer 25 may be provided in the first lower storage compartment 21*b*. The first drawer 25 may be provided such that the first drawer 25 may be drawn out from the first lower storage compartment 21*b* or may be retracted into the first lower storage compartment 21*b*, through the opening 10*a* of the main body 10. The first drawer 25 may be provided to be retracted into and drawn out along the front-rear direction (X direction). For example, the second shelf 24 may be provided in an upward direction (+Z direction) of the first drawer 25. Foods may be placed on the second shelf 24. For example, the first lower storage compartment 21*b* may be defined by the first drawer 25 and the second shelf 24.

Unlike the first upper storage compartment 21*a*, the first lower storage compartment 21*b* may be prevented from coming into contact with external air even when the door 30 is opened with respect to the main body 10. Therefore, the first lower storage compartment 21*b* may be provided as a space for foods that need to be stored for a relatively long time compared to the first upper storage compartment 21*a*.

For example, the second drawer 26 may be provided in the second storage compartment 22. The second drawer 26 may be provided such that the second drawer 26 may be drawn out from the second storage compartment 22 or may be retracted into the second storage compartment 22, through the opening 10*a* of the main body 10. The second drawer 26 may be provided to be retracted into and drawn out along the front-rear direction (X direction). For example, the partition 70 may be provided in an upward direction (+Z direction) of the second drawer 26. For example, the second storage compartment 22 may be defined by the second drawer 26 and the partition 70. However, a size of the second storage compartment 22 may vary depending on a position of the partition 70.

The first storage compartment 21 may be provided as the refrigerating compartment 21 and the second storage compartment 22 may be provided as the freezing compartment 22. In this case, the ice maker 27 may be disposed inside the second storage compartment 22. However, this is merely exemplary, and the first storage compartment 21 may be provided as a freezing compartment and the second storage compartment 22 may be provided as a refrigerating compartment. In this case, the ice maker 27 may be disposed inside the first storage compartment 21.

Hereinafter, for convenience of explanation, a case in which the first storage compartment 21 is provided as the refrigerating compartment 21 and the second storage compartment 22 is provided as the freezing compartment 22 will be described as an example.

The refrigerating compartment 21 may be provided to keep foods in a refrigerated state. The refrigerating compartment 21 may be kept at an appropriate temperature for storing foods in the refrigerated state. For example, the refrigerating compartment 21 may be implemented in a range of −0.5 degrees Celsius to 8.0 degrees Celsius. However, this is merely exemplary, and the refrigerating compartment 21 may have various temperature ranges. The user may change the temperature range in the refrigerating compartment 21 as needed.

The freezing compartment 22 may be provided to keep foods in a frozen state. The freezing compartment 22 may be kept at an appropriate temperature for storing foods in the frozen state. For example, the freezing compartment 22 may be implemented in a range of −24.5 degrees Celsius to −13 degrees Celsius. However, this is merely exemplary, and the freezing compartment 22 may have various temperature ranges. The user may change the temperature range in the freezing compartment 22 as needed.

The refrigerator 1 may include the cooling system provided to generate cold air using a cooling cycle and supply the generated cold air to the storage compartment 20. The cooling system may generate cold air by using latent heat of evaporation of a refrigerant in the cooling cycle.

For example, the refrigerator 1 may include a compressor 11. The refrigerator 1 may include a condenser. The refrigerator 1 may include an expansion valve. The refrigerator 1 may include an evaporator 12. The refrigerator 1 may include a fan 13. The cooling system may include at least one of the compressor 11, the condenser, the expansion valve, the evaporator 12, and the fan 13. The cooling system may be referred to as a cold air generating device.

A cooling chamber 20*b* may be provided in the main body 10. For example, the evaporator 12, and/or the fan 13 may be provided in the cooling chamber 20*b*. The cooling chamber 20*b* may be provided as a partial space of the storage compartment 20. The cooling chamber 20*b* may be provided to communicate with the refrigerating compartment 21. The cooling chamber 20*b* may be provided to communicate with the freezing compartment 22. The cooling chamber 20*b* may be referred to as the cold air generating space 20*b*.

A machine room 15 may be provided in the main body 10. For example, the compressor 11, and/or the condenser may be provided in the machine room 15.

Components of the refrigerator 1 constituting the cooling system may have relatively non-light weights. Therefore, the cooling chamber 20*b* and the machine room 15 may be provided in a lower portion of the main body 10. However, embodiments are not limited thereto, and the cooling chamber 20*b* and the machine room 15 may be disposed in various ways and the components constituting the cooling system may be disposed in various ways to correspond to the positions of the cooling chamber 20*b* and the machine room 15.

Because cold air is generated by the evaporator 12 in the cooling chamber 20*b*, the cooling chamber 20*b* may be kept at a relatively low temperature. Unlike this, because heat is generated in the machine room 15 by, for example, the compressor 11, and/or the condenser, the machine room 15 may be kept at a relatively high temperature. Accordingly, the cooling chamber 20*b* and the machine room 15 may be formed in a space separated from each other to be thermally insulated. For example, the main body insulator 55 may be provided between the cooling chamber 20*b* and the machine room 15.

The evaporator 12 provided in the cooling chamber 20*b* may generate cold air by evaporating the refrigerant, and the cold air generated by the evaporator 12 may be flowed by the fan 13. The cold air flowed by the fan 13 may be supplied to the storage compartment 20. The evaporator 12 may generate cold air in the cooling chamber 20*b*, and the cold air generated by the evaporator 12 may be flowed from the cooling chamber 20*b* to the refrigerating compartment 21 and/or the freezing compartment 22 by the fan 13.

The refrigerator 1 may be an indirect cooling refrigerator. Hereinafter, for convenience of description, the refrigerator 1 is described on the premise that it is an indirect cooling refrigerator, but embodiments are not limited thereto and may be applied to a direct cooling refrigerator.

For example, the evaporator 12, and/or the fan 13 disposed in the cooling chamber 20*b* may be referred to as a cold air supply device in that they supply cold air to the storage compartment 20 by generating and flowing the cold air.

The refrigerator 1 may include a damper 14. The damper 14 may be accommodated inside a cold air duct 80, which will be described later. The damper 14 may be provided to open or close a flow path formed inside the cold air duct 80. For example, the damper 14 may be provided to open or close a first discharge flow path 340 of the cold air duct 80, which will be described later. For example, the damper 14 may be provided to adjust a degree of opening of the first discharge flow path 340 of the cold air duct 80, which will be described later.

For example, the only one evaporator 12 may be provided in the cooling chamber 20*b*. The fan 13 may flow the cold air generated by the one evaporator 12 into the refrigerating compartment 21 and the freezing compartment 22, respectively. In this case, the cold air generated by the one evaporator 12 may have a temperature within a certain range. Therefore, in order to keep the refrigerating compartment 21 and the freezing compartment 22 at different temperatures, amounts of cold air respectively introduced into the refrigerating compartment 21 and the freezing compartment 22 may be different. As an example, the damper 14 may be disposed on the first discharge flow path 340 of the cold air duct 80 to adjust an amount of cold air directing to the refrigerating compartment 21.

For example, when the damper 14 opens the first discharge flow path 340 of the cold air duct 80, the cold air generated by the evaporator 12 may flow into the refrigerating compartment 21 and the freezing compartment 22. For example, when the damper 14 closes the first discharge flow path 340 of the cold air duct 80, the cold air generated by the evaporator 12 may flow into the freezing compartment 22.

However, embodiments are not limited to the above example, and various configurations may be provided for keeping the refrigerating compartment 21 and the freezing compartment 22 at different temperatures. For example, two or more evaporators may be provided in the cooling chamber 20*b*.

The refrigerator 1 may include the cold air duct 80. The cold air duct 80 may form a flow path so that cold air may flow therethrough. The cold air duct 80 may be provided to guide cold air inside the inner case 60. The cold air duct 80 may be provided to return cold air inside the storage compartment 20 and guide the returned cold air to the evaporator 12. The cold air duct 80 may be provided to guide the cold air generated by the evaporator 12 into the storage compartment 20. The cold air duct 80 may be provided to supply the cold air generated by the evaporator 12 to the refrigerating compartment 21 and the freezing compartment 22.

The cold air duct 80 may be provided such that the storage compartment 20 may be partitioned into a storage space 20*a* and the cooling chamber 20*b*. The storage space 20*a* may be a space in which the refrigerating compartment 21 and the freezing compartment 22 are formed. The cooling chamber 20*b* may be a space in which the evaporator 12 is disposed. The cooling chamber 20*b* may be provided at the rear of at least a part of the storage space 20*a*.

For example, as the cold air duct 80 is mounted on the rear wall 65 of the inner case 60, the storage compartment 20 may be divided into the storage space 20*a* and the cooling chamber 20*b*. For example, when the cold air duct 80 is mounted on an inner side of the rear wall 65, the storage space 20*a* may be a space formed in front of the cold air duct 80 in the storage compartment 20. For example, when the cold air duct 80 is mounted on the inner side of the rear wall 65, the cooling chamber 20*b* may be a space formed in the rear of the cold air duct 80 in the storage compartment 20. For example, the cooling chamber 20*b* may be formed between the cold air duct 80 and the rear wall 65 of the inner case 60.

The refrigerator 1 may include a cold air connector 90. The cold air connector 90 may be provided to deliver cold air inside the refrigerating compartment 21 to the evaporator 12. The cold air connector 90 may be provided to be connectable to the cold air duct 80. One side of the cold air connector 90 may communicate with the cold air duct 80. The other side of the cold air connector 90 may communicate with the cooling chamber 20*b*.

The cold air connector 90 may be disposed outside the inner case 60. The cold air connector 90 may be disposed between the inner case 60 and the outer case 50. For example, the cold air connector 90 may be provided to be embedded in the main body insulator 55.

For example, the refrigerator 1 may have the only one evaporator 12. In this case, the cold air in the refrigerating compartment 21 having a relatively higher temperature than that of the freezing compartment 22 needs to be returned to the cooling chamber 20*b* to exchange heat with the evaporator 12. In order to deliver the cold air inside the refrigerating compartment 21 to the cooling chamber 20*b*, the cold air connector 90 may be provided.

Figure 3:
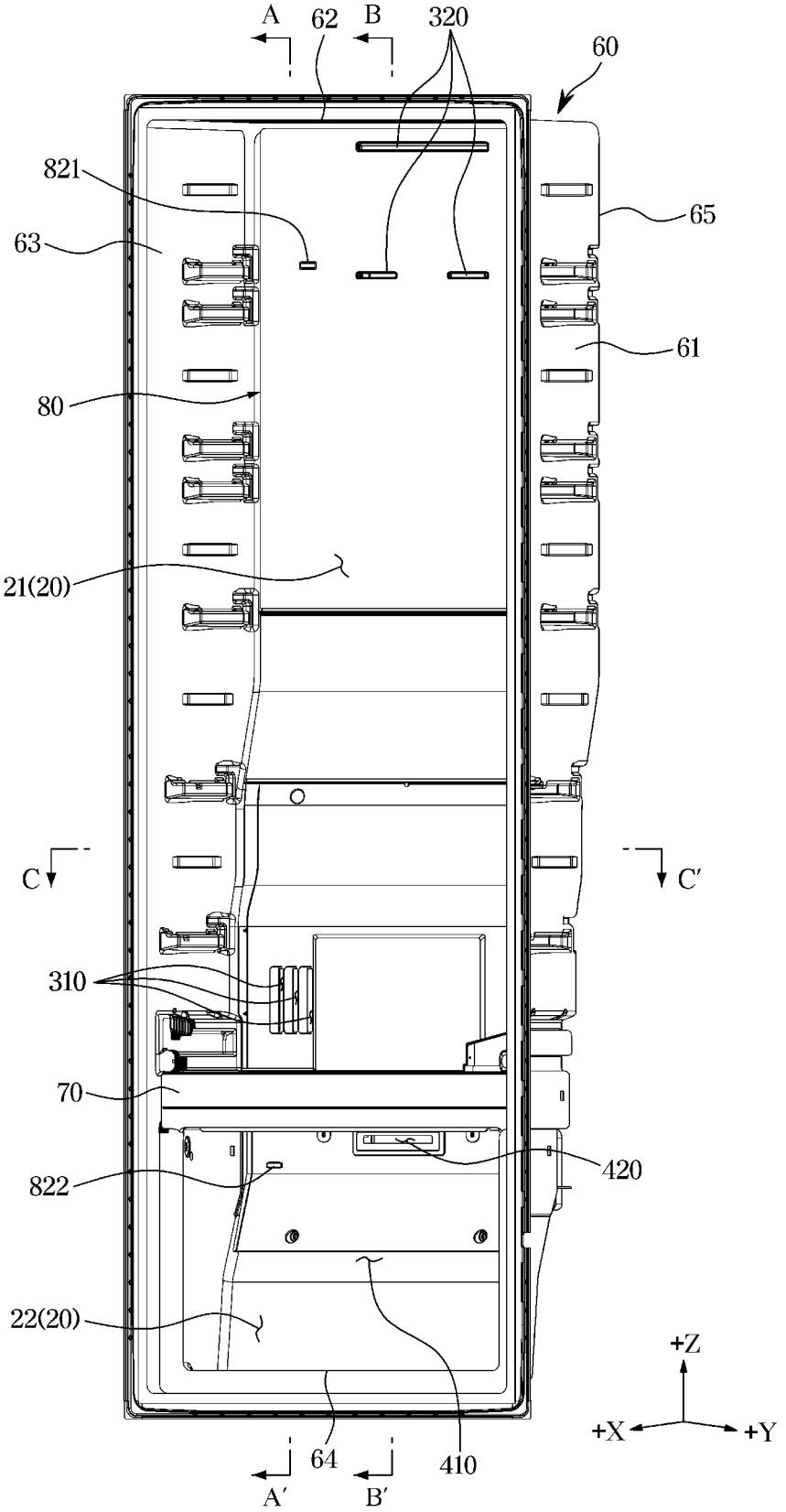
FIG. 3 is a perspective view of some configurations of the refrigerator according to an embodiment.
Figure 4:
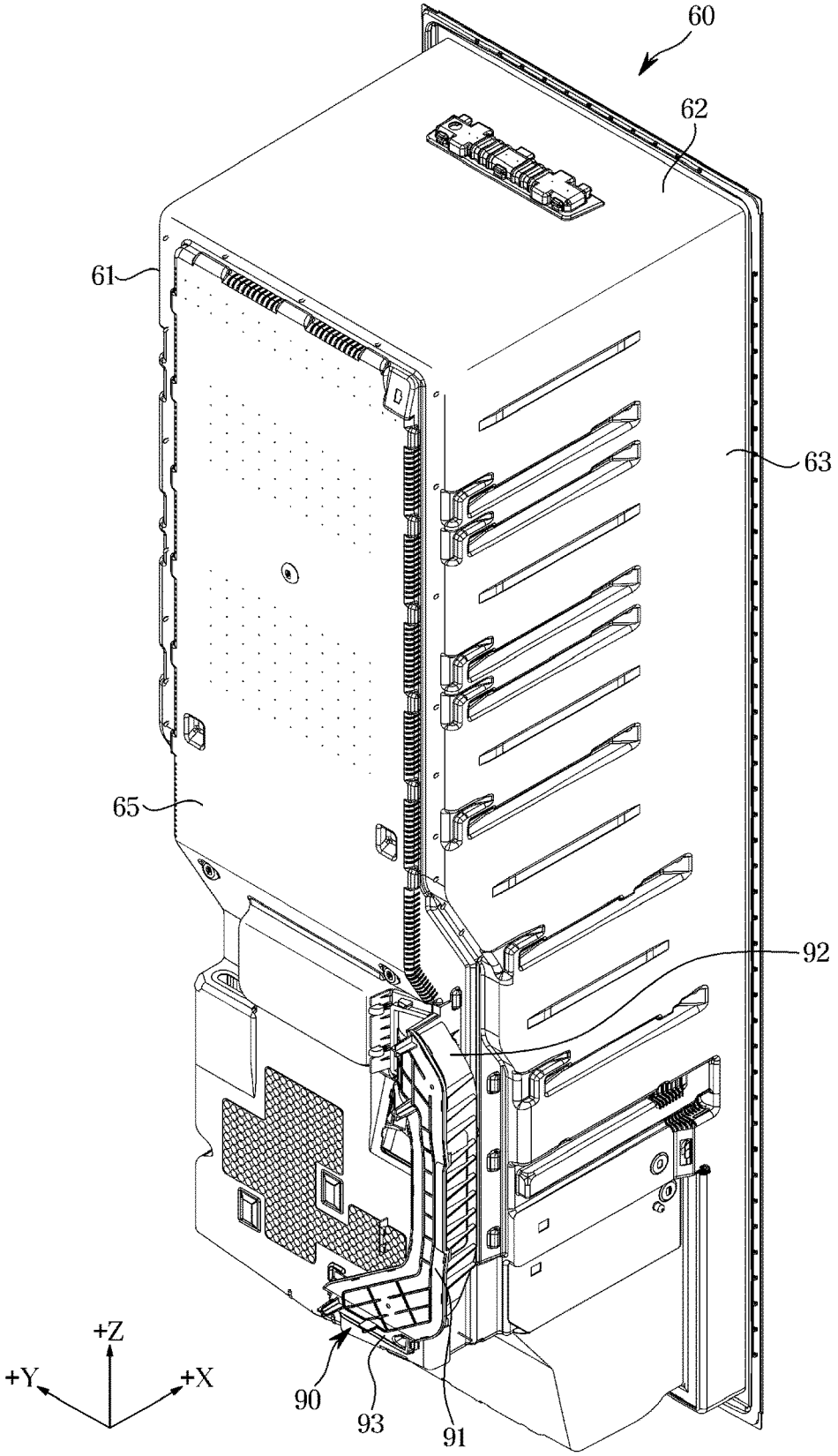
FIG. 4 is a perspective view illustrating the some configurations of the refrigerator shown in FIG. 3 from the rear.
Figure 5:
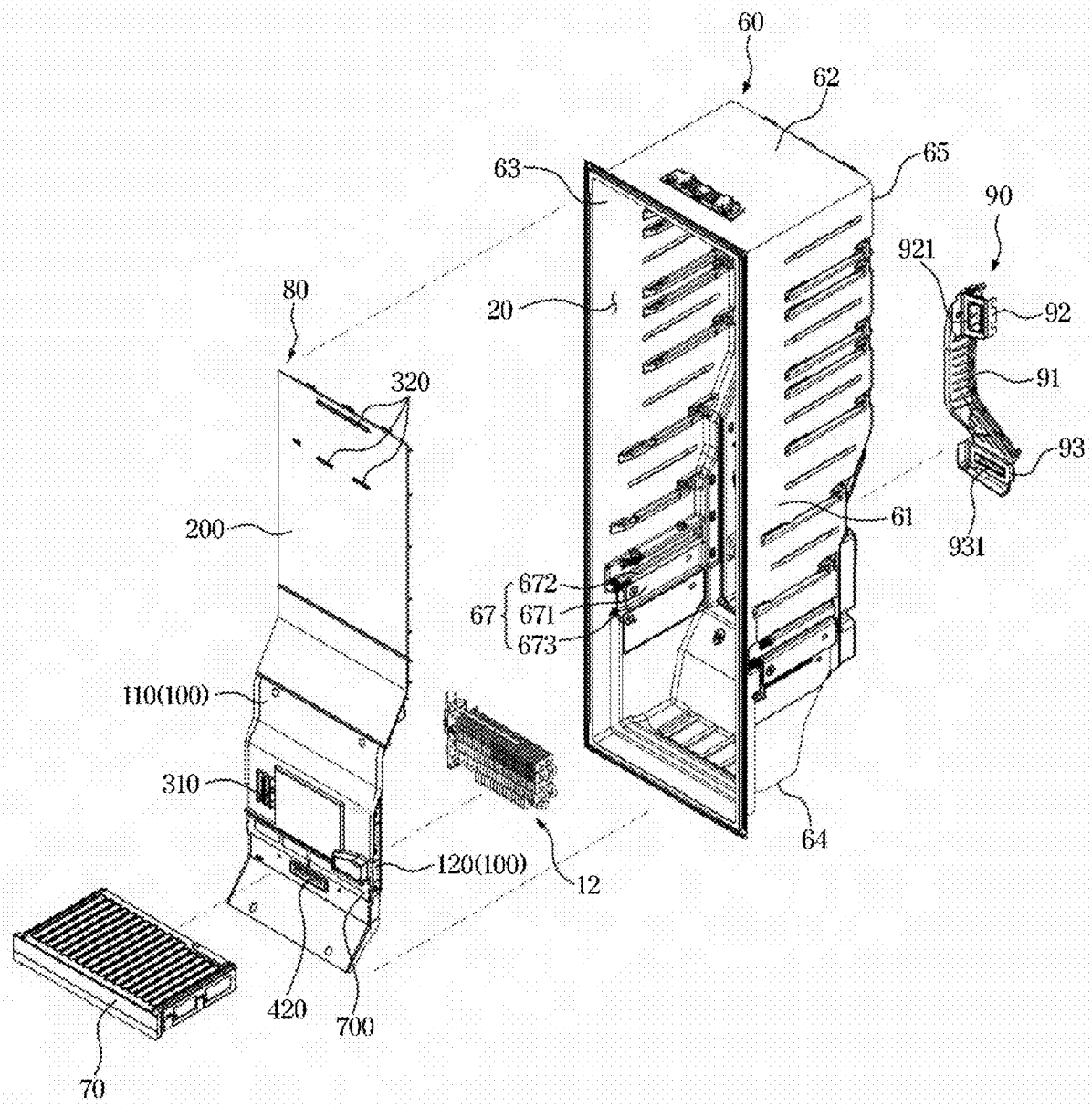
FIG. 5 is an exploded perspective view of the some configurations of the refrigerator shown in FIG. 3.
Figure 6:
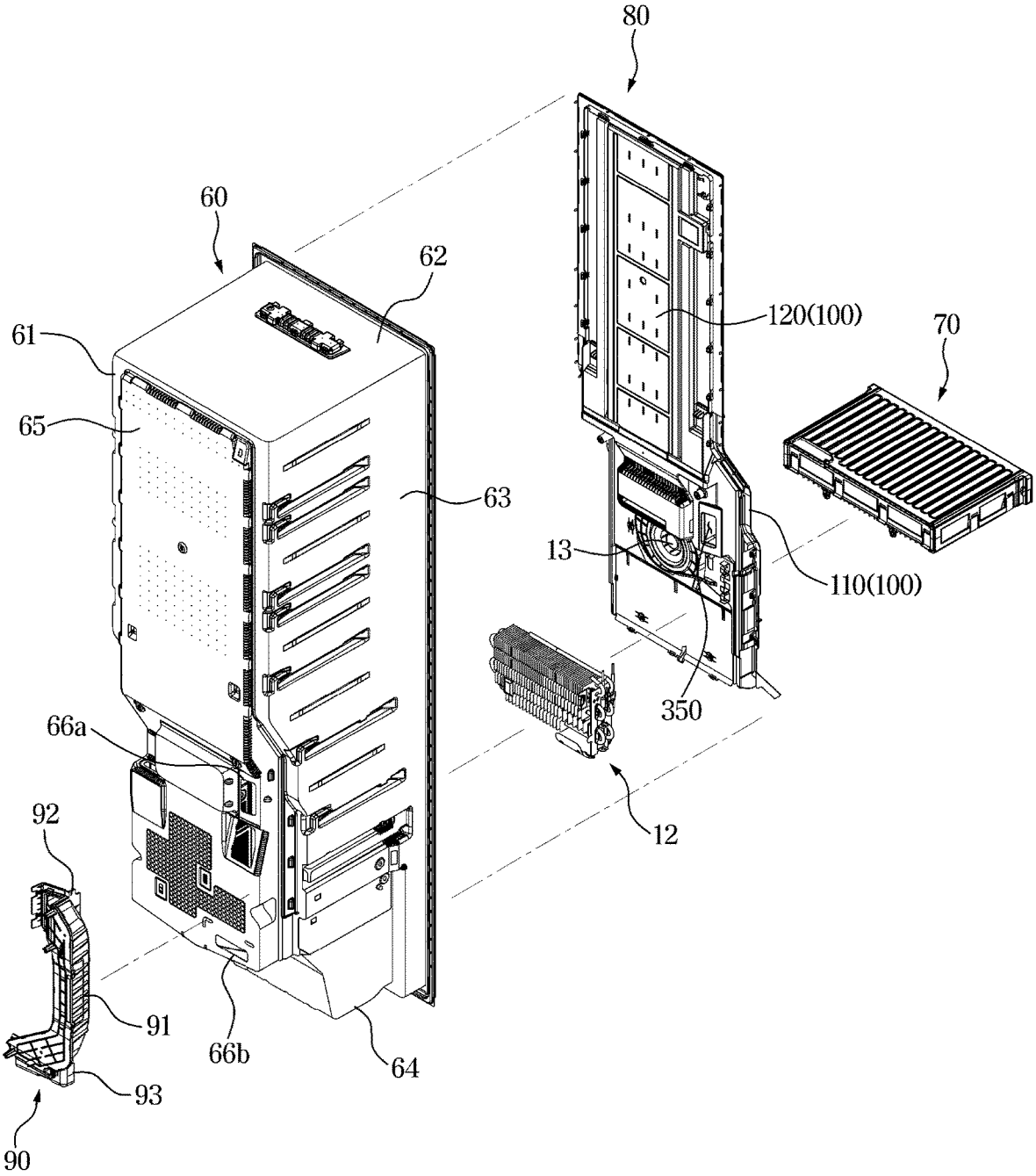
FIG. 6 is an exploded perspective view illustrating the some configurations of the refrigerator shown in FIG. 5 from the rear.

FIG. 3 is a perspective view of some configurations of the refrigerator according to an embodiment. FIG. 4 is a perspective view illustrating the some configurations of the refrigerator shown in FIG. 3 from the rear. FIG. 5 is an exploded perspective view of the some configurations of the refrigerator shown in FIG. 3. FIG. 6 is an exploded perspective view illustrating the some configurations of the refrigerator shown in FIG. 5 from the rear.

The inner case 60 may not be divided into a refrigerating compartment inner case and a freezing compartment inner case. Therefore, the inner case 60 may include the storage compartment 20 formed as one space. That is, the storage compartment 20 is formed as one space, and may not be divided into a storage compartment formed by the refrigerating compartment inner case and a storage compartment formed by the freezing compartment inner case. As will be described later, the storage compartment 20 formed as one space may be partitioned into a plurality of storage compartments by the partition 70.

For example, the refrigerator 1 may not include at least two or more ducts (e.g., a refrigerating compartment duct and a freezing compartment duct) in order to deliver the cold air generated by the evaporator 12 to each of the refrigerating compartment and the freezing compartment. For example, the refrigerator 1 may not include a component for connecting the refrigerating compartment inner case and the freezing compartment inner case. For example, the refrigerator 1 may include the one cold air duct 80.

For example, the refrigerator 1 may not include at least two or more doors (e.g., a refrigerating compartment door and a freezing compartment door) in order to open or close the storage compartment formed by the refrigerating compartment inner case and the storage compartment formed by the freezing compartment inner case, respectively. For example, the refrigerator 1 may include the one door 30.

The cold air duct 80 may be provided inside the inner case 60. The cold air duct 80 may be disposed in the storage compartment 20. For example, the cold air duct 80 may be disposed at the rear of the partition 70 inside the inner case 60. For example, at least a portion of the cold air duct 80 may be disposed in front of the evaporator 12.

The cold air duct 80 may be detachably mounted inside the inner case 60. The cold air duct 80 may be detachably coupled to the rear wall 65 of the inner case 60.

The cold air duct 80 may extend along a height direction (Z direction) of the main body 10. The cold air duct 80 may extend along a height direction (Z direction) of the inner case 60. The cold air duct 80 may extend along a height direction (Z direction) of the storage compartment 20. The cold air duct 80 may extend along an up-down direction (Z direction). The cold air duct 80 may extend along the height direction of the storage compartment 20 between the evaporator 12 and the partition 70. One portion of the cold air duct 80 may correspond to the refrigerating compartment 21, and the other portion of the cold air duct 80 may correspond to the freezing compartment 22.

The cold air duct 80 may be provided as one cold air duct. The one cold air duct 80 may be provided to supply cold air to both the refrigerating compartment 21 and the freezing compartment 22. That is, without the need to provide both a refrigerating compartment duct for supplying cold air to the refrigerating compartment 21 and a freezing compartment duct for supplying cold air to the freezing compartment 22, cold air may be supplied to the refrigerating compartment 21 and the freezing compartment 22 through the one cold air duct 80.

In addition, as the one cold air duct 80 is disposed in the storage compartment 20, an integral sense of aesthetics may be formed. That is, without being divided into a refrigerating compartment duct for supplying cold air to the refrigerating compartment 21 and a freezing compartment duct for supplying cold air to the freezing compartment 22, as the one cold air duct 80 is provided at a rear portion of the storage compartment 20, a seamless aesthetic may be formed. For example, a front surface of the cold air duct 80 corresponding to the refrigerating compartment 21 and a front surface of the cold air duct 80 corresponding to the freezing compartment 22 may be seen as one surface. As a result, aesthetics of the inside of the refrigerator 1 may be improved.

The cold air duct 80 may include return holes 310 and 410 provided to return cold air from the storage compartment 20. The return holes 310 and 410 may be provided to return cold air inside the storage compartment 20. The return holes 310 and 410 may be provided to draw cold air circulated through the storage compartment 20.

For example, the cold air duct 80 may include the first return hole 310 for returning cold air inside the refrigerating compartment 21. For example, the first return hole 310 may be provided to communicate with the refrigerating compartment 21. For example, the first return hole 310 may be positioned below a first discharge hole 320, which will be described later.

For example, the cold air duct 80 may include the second return hole 410 for returning cold air inside the freezing compartment 22. For example, the second return hole 410 may be provided to communicate with the freezing compartment 22. For example, the second return hole 410 may be positioned below a second discharge hole 420, which will be described later.

The cold air duct 80 may form return flow paths 330 and 430 (see FIGS. 9 and 10) through which cold air returned from the storage compartment 20 flows. The cold air returned from the storage compartment 20 may flow toward the evaporator 12 along the return flow paths 330 and 430.

For example, the cold air duct 80 may form the first return flow path 330 through which cold air returned from the refrigerating compartment 21 flows. The first return flow path 330 may be provided to guide cold air inside the refrigerating compartment 21. The first return flow path 330 may be provided to guide cold air returned through the first return hole 310 to the evaporator 12. The first return flow path 330 may be provided to guide cold air returned from the refrigerating compartment 21 to the evaporator 12.

For example, the first return flow path 330 may be provided to guide cold air inside the refrigerating compartment 21 to the cold air connector 90. For example, the first return flow path 330 may extend from the refrigerating compartment 21 to the cold air connector 90. For example, the first return flow path 330 may have a shape extending rearward from the refrigerating compartment 21.

For example, the first return flow path 330 may be provided to communicate the refrigerating compartment 21 and the cold air connector 90.

The first return flow path 330 may be provided to communicate with the refrigerating compartment 21. For example, the first return flow path 330 may be provided to communicate with the refrigerating compartment 21 through the first return hole 310. For example, one side 331 of the first return flow path 330 may be provided to receive cold air returned from the refrigerating compartment 21.

The first return flow path 330 may be provided to communicate with the cooling chamber 20*b*. For example, the first return flow path 330 may be provided to communicate with the cooling chamber 20*b* through the cold air connector 90. For example, the other side 332 of the second return flow path 330 may be provided to provide cold air returned from the refrigerating compartment 21 to the cold air connector 90. However, embodiments are not limited thereto, and the first return flow path 330 may be provided to communicate directly with the cooling chamber 20*b*.

For example, the cold air duct 80 may form the second return flow path 430 through which cold air returned from the freezing compartment 22 flows. The second return flow path 430 may be provided to guide cold air returned through the second return hole 410 to the evaporator 12. The second return flow path 430 may be provided to guide cold air returned from the freezing compartment 22 to the evaporator 12.

For example, the second return flow path 430 may be provided to guide cold air inside the freezing compartment 22 to the evaporator 12. For example, the second return flow path 430 may extend from the freezing compartment 22 to the cooling chamber 20*b*. For example, the second return flow path 430 may have a shape extending rearward from the freezing compartment 22.

The second return flow path 430 may be provided to communicate with the freezing compartment 22. For example, the second return flow path 430 may be provided to communicate with the freezing compartment 22 through the second return hole 410. For example, one side of the second return flow path 430 may be provided to receive cold air returned from the freezing compartment 22.

The second return flow path 430 may be provided to communicate with the cooling chamber 20*b*. For example, the other side of the second return flow path 430 may be provided to provide cold air returned from the freezing compartment 22 to the cooling chamber 20*b*.

The cold air duct 80 may include the discharge holes 320 and 420 for supplying the cold air generated from the evaporator 12 to the storage compartment 20. The discharge holes 320 and 420 may be provided to provide relatively low-temperature cold air to the storage compartment 20 by exchanging heat with the evaporator 12.

For example, the cold air duct 80 may include the first discharge hole 320 for supplying the cold air generated by the evaporator 12 to the refrigerating compartment 21. For example, the first discharge hole 320 may be provided to communicate with the refrigerating compartment 21.

For example, the first discharge hole 320 may be positioned above the first return hole 310. Relatively low-temperature cold air may move downward due to convection. Considering this, the first discharge hole 320 may be provided to communicate with an upper portion of the refrigerating compartment 21. The first return hole 310 may be disposed far from the first discharge hole 320 so as not to immediately return cold air discharged from the first discharge hole 320. The first return hole 310 may be provided to communicate with a lower portion of the refrigerating compartment 21. However, this is merely exemplary, and the first discharge hole 320 may be positioned below the first return hole 310.

For example, the cold air duct 80 may include the second discharge hole 420 for supplying the cold air generated by the evaporator 12 to the freezing compartment 22. For example, the second discharge hole 420 may be provided to communicate with the freezing compartment 22.

For example, the second discharge hole 420 may be positioned above the second return hole 410. Relatively low-temperature cold air may move downward due to convection. Considering this, the second discharge hole 420 may be provided to communicate with the upper portion of the refrigerating compartment 21. The second return hole 410 may be disposed far from the second discharge hole 420 so as not to immediately return cold air discharged from the second discharge hole 420. The second return hole 410 may be provided to communicate with the lower portion of the refrigerating compartment 21. However, this is merely exemplary, and the second discharge hole 420 may be positioned below the second return hole 410.

The cold air duct 80 may form discharge the flow paths 340 and 440 (see FIGS. 11 to 13) through which the cold air generated from the evaporator 12 flows. Cold air heat-exchanged with the evaporator 12 may flow toward the storage compartment 20 along the discharge flow paths 340 and 440.

For example, the cold air duct 80 may form the first discharge flow path 340 through which the cold air generated by the evaporator 12 flows. The first discharge flow path 340 may be provided to guide the cold air generated by the evaporator 12 to the first discharge hole 320. The first discharge flow path 340 may be provided to communicate with the cooling chamber 20*b*. The first discharge flow path 340 may be provided to communicate with the refrigerating compartment 21 through the first discharge hole 320.

For example, the cold air duct 80 may form the second discharge flow path 440 through which the cold air generated by the evaporator 12 flows. The second discharge flow path 440 may be provided to guide the cold air generated by the evaporator 12 to the second discharge hole 420. The second discharge flow path 440 may be provided to communicate with the cooling chamber 20*b*. The second discharge flow path 440 may be provided to communicate with the freezing compartment 22 through the second discharge hole 420.

The evaporator 12 may be disposed in the storage compartment 20. The evaporator 12 may be provided between the cold air duct 80 and the inner case 60. The evaporator 12 may be disposed at the rear of the cold air duct 80. The evaporator 12 may be disposed in front of the rear wall 65 of the inner case 60. The evaporator 12 may be disposed in the cooling chamber 20*b* (see FIG. 2) to exchange heat with cold air introduced into the cooling chamber 20*b*.

The refrigerator 1 may include the partition 70. The partition 70 may be provided inside the inner case 60. The partition 70 may be disposed in the storage compartment 20. The partition 70 may partition the storage compartment 20 into a plurality of storage compartments. The partition 70 may partition the storage compartment 20 into the refrigerating compartment 21 and the freezing compartment 22. The partition 70 may form the refrigerating compartment 21 and the freezing compartment 22.

The partition 70 may be disposed in front of the cold air duct 80. The partition 70 may be detachably mounted in the cold air duct 80. For example, the partition 70 may be detachably coupled to the front surface of the cold air duct 80.

For example, the cold air duct 80 may include a first partition mounting part 700, and the partition 70 may be detachably coupled to the first partition mounting part 700. For example, the first partition mounting part 700 may have a protrusion and/or groove shape for fixing the partition 70. For example, the first partition mounting part 700 may be formed on the front surface of the cold air duct 80. However, embodiments are not limited to the above example, and the cold air duct 80 may include various shapes so that the partition 70 may be mounted thereon.

The partition 70 may be detachably mounted in the main body 10. The partition 70 may be detachably mounted in the inner case 60. For example, the partition 70 may be detachably coupled to at least one of the left wall 63 or the right wall 61 of the inner case 60. For example, the partition 70 may be provided to form the refrigerating compartment 21 and the freezing compartment 22 by being detachably mounted inside the inner case 60.

For example, the inner case 60 may include a second partition mounting part 67, and the partition 70 may be detachably coupled to the second partition mounting part 67. For example, the partition mounting part 67 may be formed on at least one of both the side walls 61 and 63 of the inner case 60. For example, the second partition mounting part 67 may include a rail part 671. For example, the partition 70 may slide along the rail part 671. For example, the partition 70 may be provided such that the partition 70 may be drawn out from and retracted into the inner case 60. For example, the second partition mounting part 67 may include a first support protrusion 672 formed on an upper side of the rail part 671 to support an upper surface of the partition 70. For example, the second partition mounting part 67 may include a second support protrusion 673 formed on a lower side of the rail part 671 to support a lower surface of the partition 70. However, embodiments are not limited to the above example, and the inner case 60 may include various shapes so that the partition 70 may be mounted thereon.

The partition 70 may include a partition insulator 71 (see FIG. 2). The partition insulator 71 may be provided inside the partition 70. The partition insulator 71 may prevent heat exchange between the refrigerating compartment 21 and the freezing compartment 22.

For example, a urethane foam insulation, an expanded polystyrene insulation, and/or a vacuum insulation panel may be used as the partition insulator 71. However, embodiments are not limited thereto, and the partition insulator 71 may be configured to include various materials.

The cold air connector 90 may be disposed at the rear of the inner case 60. The cold air connector 90 may be detachably mounted on the outside of the inner case 60. The cold air connector 90 may be detachably coupled to the rear wall 65 of the inner case 60.

The cold air connector 90 may extend along a direction in which the refrigerating compartment 21 and the freezing compartment 22 are arranged. For example, the cold air connector 90 may have a shape extending along the up-down direction (Z direction). However, embodiments are not limited thereto, and in a case in which the refrigerating compartment 21 and the freezing compartment 22 are arranged side by side, the cold air connector 90 may have a shape extending along a left-right direction (Y direction).

For example, the cold air connector 90 may include a connector body 91 forming an exterior of the cold air connector 90. A flow path through which cold air flows may be formed inside the connector body 91.

For example, the cold air connector 90 may include an inlet part 92 formed on one side of the connector body 91. The inlet part 92 may include an inlet hole 921 provided to receive cold air returned from the refrigerating compartment 21. The inlet hole 921 may be provided to communicate with the refrigerating compartment 21. The inlet hole 921 may be provided to communicate with the first return flow path 330. The inlet hole 921 may be provided to communicate with a first guide hole **66*a* formed on the rear wall 65 of the inner case 60**.

For example, the cold air connector 90 may include an outlet part 93 formed on the other side of the connector body 91. The outlet part 93 may include an outlet hole 931 provided to discharge cold air introduced into the cold air connector 90 to the cooling chamber **20*b*. The outlet hole 931 may be provided to communicate with the cooling chamber 20*b*. The outlet hole 931 may be provided to communicate with a second guide hole 66*b* formed on the rear wall 65 of the inner case 60**.

The refrigerator 1 may include at least one temperature sensor. For example, the refrigerator 1 may include a first temperature sensor 821 (see FIG. 3) provided to detect a temperature of the refrigerating compartment 21. For example, the refrigerator 1 may include a second temperature sensor 822 (see FIG. 3) provided to detect a temperature of the freezing compartment 22. A controller 810 (see FIG. 22) may control an operation of the damper 14 based on information obtained from at least one of the first temperature sensor 821 or the second temperature sensor 821. A detailed description thereof will be given later.

Figure 7:
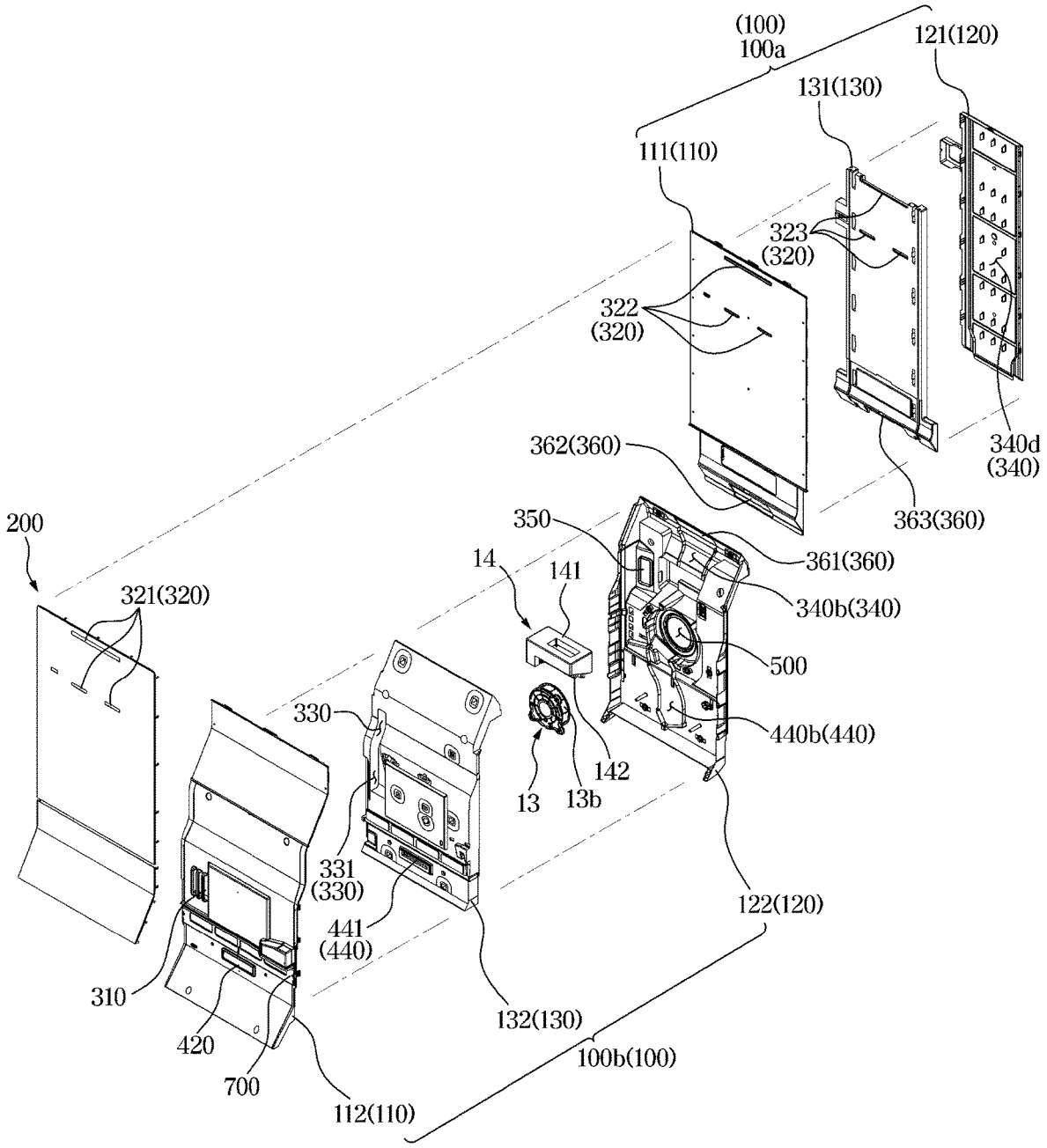
FIG. 7 is an exploded perspective view of a duct assembly according to an embodiment.
Figure 8:
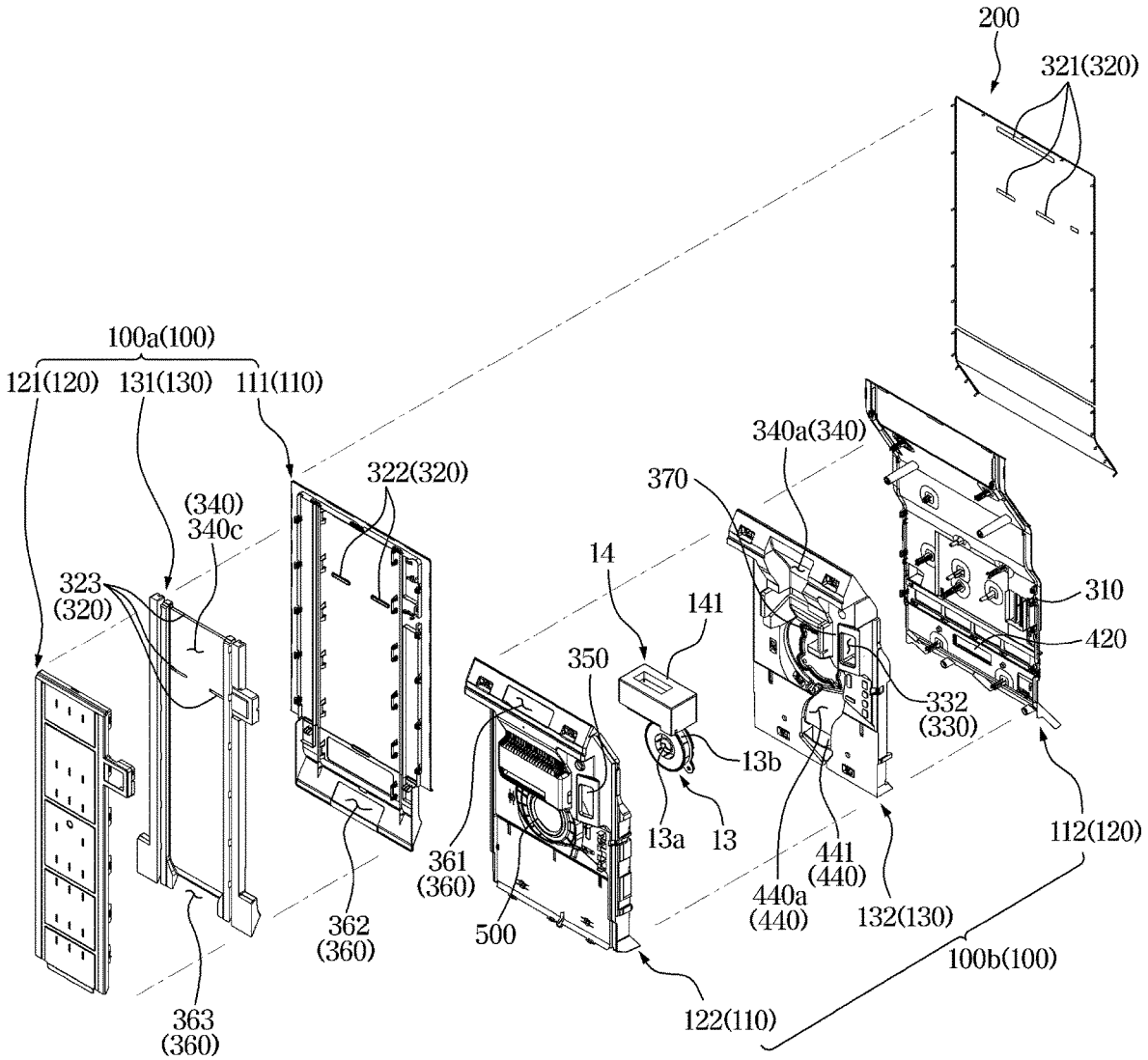
FIG. 8 is an exploded perspective view illustrating the duct assembly shown in FIG. 7 from the rear.

FIG. 7 is an exploded perspective view of a duct assembly according to an embodiment. FIG. 8 is an exploded perspective view illustrating the duct assembly shown in FIG. 7 from the rear.

An example of a duct assembly will be described below with reference to FIGS. 7 and 8. The duct assembly may refer to the cold air duct 80 and components accommodated in the cold air duct 80.

The cold air duct 80 may include a duct body 100. The duct body 100 may form an exterior of the cold air duct 80. The duct body 100 may form a flow path through which cold air flows.

The duct body 100 may include a front body 110 and a rear body 120. The front body 110 may be coupled to the front of the rear body 120. The front body 110 may be provided to face the storage compartment 20. The front body 110 may be provided to be exposed toward the storage compartment 20. The front body 110 may be provided to face the refrigerating compartment 21 and the freezing compartment 22. The front body 110 may be provided to be exposed toward the refrigerating compartment 21 and the freezing compartment 22.

For example, the front body 110 may include a first front body 111 of a first body unit **100*a*, which will be described later, and a second front body 112 of a second body unit 100*b*, which will be described later. Although the drawings illustrate that the first front body 111 and the second front body 112 are provided as separate structures, the first front body 111 and the second front body 112** may be provided as an integral structure.

The rear body 120 may be coupled to the rear of the front body 110. The rear body 120 may be provided to face a rear surface of the inner case 60. The rear body 120 may be disposed to face the rear wall 65 of the inner case 60.

For example, the rear body 120 may include a first rear body 121 of the first body unit 100*a*, which will be described later, and a second rear body 122 of the second body unit 100*b*, which will be described later. Although the drawings illustrate that the first rear body 121 and the second rear body 122 are provided as separate structures, the first rear body 121 and the second rear body 122 may be provided as an integral structure.

The front body 110 and the rear body 120 may be detachably coupled. However, embodiments are not limited thereto, and the front body 110 and the rear body 120 may be provided as an integral structure.

The duct body 100 may include a support member 130 disposed between the front body 110 and the rear body 120. The support member 130 may be provided to support at least one of the front body 110 and the rear body 120. The support member 130 may be provided to fix the front body 110 with respect to the rear body 112. For example, the support member 130 may be provided to come into surface contact with at least one of the front body 110 and the rear body 120 when the front body 110 and the rear body 120 are coupled.

The support member 130 may form a flow path so that cold air may flow therethrough. A predetermined space may be provided between the support member 130 and the rear body 120. The support member 130 may form the first return flow path 330. The support member 130 may form the first discharge flow path 340 as the support member 130 is coupled to the rear body 120. The support member 130 may form the second discharge flow path 440 as the support member 130 is coupled to the rear body 120.

For example, the support member 130 may include a first support member 131 of the first body unit 100*a*, which will be described later, and a second support member 132 of the second body unit 100*b*, which will be described later. Although the drawings illustrate that the first support member 131 and the second support member 132 are provided as separate structures, the first support member 131 and the second support member 132 may be provided as an integral structure.

The support member 130 may be provided to insulate between the front body 110 and the rear body 120. The support member 130 may prevent heat exchange between the front body 110 and the rear body 120. Therefore, a temperature of cold air flowing in the cold air duct 80 may be kept constant.

For example, the support member 130 may include at least one of an expanded polystyrene insulation, a urethane foam insulation, and a vacuum insulation panel. However, embodiments are not limited thereto, and the support member 130 may include various materials to improve insulation performance of the cold air duct 80. The support member 130 may be referred to as the insulation member 130.

The duct body 100 may include the first body unit 100*a* and the second body unit 100*b*. The first body unit 100*a* may form an upper exterior of the duct body 100. The second body unit 100*b* may form a lower exterior of the duct body 100. The first body unit 100*a* may be referred to as the upper body unit 100*a*. The second body unit 100*b* may be referred to as the lower body unit 100*b*.

The first body unit 100*a* and the second body unit 100*b* may be detachably coupled. However, embodiments are not limited thereto, and the first body unit 100*a* and the second body unit 100*b* may be provided as an integral structure.

For example, the first body unit 100*a* may include the first front body 111 and the first rear body 121.

The first front body 111 may be coupled to the front of the first rear body 121. The first front body 111 may be exposed toward the storage compartment 20. The first rear body 121 may be coupled to the rear of the first front body 111. The first rear body 121 may be provided to face the rear wall 65 of the inner case 60.

For example, the first body unit 100*a* may include the first support member 131 disposed between the first front body 111 and the first rear body 121. The first support member 131 may be provided to support at least one of the first front body 111 and the first rear body 121. The first support member 131 may be provided to fix the first front body 111 with respect to the first rear body 121.

For example, the second body unit 100*b* may include the second front body 112 and the second rear body 122.

The second front body 112 may be coupled to the front of the second rear body 122. The second front body 112 may be exposed toward the storage compartment 20. The second rear body 122 may be coupled to the rear of the second front body 112. The second rear body 122 may be provided to face the rear wall 65 of the inner case 60.

For example, the second body unit 100*b* may include the second support member 132 disposed between the second front body 112 and the second rear body 122. The second support member 132 may be provided to support at least one of the second front body 112 and the second rear body 122. The second support member 132 may be provided to fix the second front body 112 with respect to the second rear body 122.

The cold air duct 80 may include a cover plate 200 disposed in front of the duct body 100. The cover plate 200 may be detachably mounted on a front surface of the front body 111. The cover plate 200 may be provided to cover at least a portion of the front body 111. The cover plate 200 may be provided to be exposed to the storage compartment 20. However, in a case in which the cover plate 200 is omitted, the front body 111 may be exposed to the storage compartment 20.

A design of the cover plate 200 may be freely changed. Therefore, as the design of the cover plate 200 is changed, an exterior design of the cold air duct 80 and an interior design of the refrigerator 1 may be implemented differently. The user may freely replace the cover plate 200 as needed.

The first return hole 310 may communicate with the first return flow path 330. The first return hole 310 may correspond to the one side 331 of the first return flow path 330.

For example, the first return hole 310 may be formed on the front body 110. For example, the first return hole 310 may be formed to penetrate the second front body 112.

The first return flow path 330 may communicate with the first return hole 310. The one side 331 of the first return flow path 330 may correspond to the first return hole 310. The first return flow path 330 may communicate with the outside of the cold air duct 80 through a communication hole 350. The other side 332 of the first return flow path 330 may correspond to the communication hole 350. The first return flow path 330 may extend from the first return hole 310 toward the communication hole 350.

For example, the first return flow path 330 may be formed on the support member 130. For example, the first return flow path 330 may be formed to penetrate the second support member 132.

The communication hole 350 may be provided to discharge cold air flowing in the first return flow path 330. The communication hole 350 may correspond to the first guide hole 66*a* of the inner case 60. The communication hole 350 may communicate with the first guide hole 66*a* of the inner case 60. The communication hole 350 may correspond to the inlet part 92 of the cold air connector 90. The communication hole 350 may communicate with the inlet hole 921 of the cold air connector 90. Cold air discharged from the communication hole 350 may flow to the cold air connector 90.

For example, the communication hole 350 may be formed on the rear body 120. For example, the communication hole 350 may be formed to penetrate the second rear body 122.

The first discharge flow path 340 may extend from a discharge side 13*b* of the fan 13 toward the first discharge hole 320. The first discharge flow path 340 may be formed between the support member 130 and the rear body 120.

For example, the first support member 131 may form a portion of the first discharge flow path 340 as the first support member 131 is coupled to the first rear body 121. For example, the first support member 131 may include a discharge flow path forming portion 340*c*, and the first rear body 121 may include a discharge flow path forming portion 340*d*. As the first support member 131 and the first rear body 121 are coupled, the discharge flow path forming portion 340*c* and the discharge flow path forming portion 340*d* form an upper portion 342 of the first discharge flow path 340 (see FIGS. 11 and 12). The upper portion 342 of the first discharge flow path 340 may be formed inside the first body unit 100*a*.

For example, the second support member 132 may form a portion of the first discharge flow path 340 as the second support member 132 is coupled to the second rear body 122. For example, the second support member 132 may include a discharge flow path forming portion 340*a*, and the second rear body 122 may include a discharge flow path forming portion 340*b*. As the second support member 132 and the second rear body 122 are coupled, the discharge flow path forming portion 340*a* and the discharge flow path forming portion 340*b* form a lower portion 341 of the first discharge flow path 340 (see FIGS. 11 and 12). The lower portion 341 of the first discharge flow path 340 may be formed inside the second body unit 100*b*.

For example, the cold air blown by the fan 13 may move from the lower portion 341 of the first discharge flow path 340 to the upper portion 342 of the first discharge flow path 340. For example, cold air of the lower portion 341 of the first discharge flow path 340 may pass through a connection hole 360 and flow to the upper portion 342 of the first discharge flow path 340. For example, the connection hole 360 may include a first connection hole 361 formed on the second rear body 122, a second connection hole 362 formed on the first front body 111, and a third connection hole 363 formed on the first support member 131. The first connection hole 361, the second connection hole 362, and the third connection hole 363 may overlap in the front-rear direction.

However, embodiments are not limited to the above example, and the first discharge flow path 340 may not be divided into an upper portion and a lower portion. The first discharge flow path 340 may be formed as a single flow path.

The first discharge hole 320 may communicate with the first discharge flow path 340.

For example, the first discharge hole 320 may be formed in the first body unit 100*a*. For example, the first discharge hole 320 may communicate with the upper portion 342 of the first discharge flow path 340. However, embodiments are not limited thereto, and the first discharge hole 320 may be formed in the second body unit 100*b* as long as the first discharge hole 320 may communicate with the first discharge flow path 340. The first discharge hole 320 may communicate with the lower portion 341 of the first discharge flow path 340.

For example, the first discharge hole 320 may include a first opening 321 formed on the cover plate 200, a second opening 322 formed on the first front body 111, and a third opening 323 formed on the first support member 131. The first opening 321, the second opening 322, and the third opening 323 may overlap in the front-rear direction. However, embodiments are not limited thereto, and for example, in a case in which the first discharge hole 320 is formed in the second body unit 100*b*, an opening may be provided on each of the second front body 112, the second support member 132, and the second rear body 122.

The second return hole 410 may communicate with the second return flow path 430. The second return hole 410 may be formed as the cold air duct 80 is mounted in the inner case 60. A detailed description thereof will be given later.

The second return flow path 430 may communicate with the second return hole 410. The second return flow path 430 may communicate with the cooling chamber 20*b* in which the evaporator 12 is disposed. The second return flow path 430 may be formed as the cold air duct 80 is mounted in the inner case 60. A detailed description thereof will be given later.

The second discharge flow path 440 may extend from the discharge side 13*b* of the fan 13 toward the second discharge hole 420. The second discharge flow path 440 may be formed between the support member 130 and the rear body 120.

For example, the second support member 132 may form the second discharge flow path 440 as the second support member 132 is coupled to the second rear body 122. For example, the second support member 132 may include a discharge flow path forming portion 440*a*, and the second rear body 122 may include a discharge flow path forming portion 440*b*. As the second support member 132 and the second rear body 122 are coupled, the discharge flow path forming portion 440*a* and the discharge flow path forming portion 440*b* form the second discharge flow path 440 (see FIGS. 11 and 13). The second discharge flow path 440 may be formed inside the second body unit 100*b*.

The second discharge hole 420 may communicate with the second discharge flow path 440. The second discharge hole 420 may correspond to one side of the second discharge flow path 440.

For example, the second discharge hole 420 may be formed on the front body 110. For example, the second discharge hole 420 may be formed to penetrate the second front body 112.

The fan 13 may be accommodated in the cold air duct 80. The fan 13 may generate a blowing force. The fan 13 may be disposed between the support member 130 and the rear body 120. For example, the fan 13 may be disposed between the second support member 132 and the second rear body 122.

The fan 13 may be provided to draw the cold air generated by the evaporator 12. For example, the fan 13 may draw the cold air generated by the evaporator 12 through an inlet hole 500 formed in the cold air duct 80. For example, the inlet hole 500 may be formed on the rear body 120. For example, the inlet hole 500 may be formed to penetrate the second rear body 122. For example, the inlet hole 500 may be provided to communicate with the cooling chamber 20*b*.

The fan 13 may be provided to discharge cold air drawn from the cooling chamber 20*b* toward the discharge flow paths 340 and 440. For example, a part of the cold air discharged from the fan 13 may flow toward the first discharge flow path 340, and another part of the cold air discharged from the fan 13 may flow toward the second discharge flow path 440.

An intake side 13*a* of the fan 13 may be provided to face the cooling chamber 20*b*. The intake side 13*a* of the fan 13 may communicate with the cooling chamber 20*b* through the inlet hole 500. The discharge side 13*b* of the fan 13 may be provided to face the discharge flow paths 340 and 440. The discharge side 13*b* of the fan 13 may communicate with each of the first discharge flow path 340 and the second discharge flow path 440.

For example, the fan 13 may be provided as a centrifugal fan. The fan 13 may draw cold air in an axial direction and discharge cold air in a radial direction. However, embodiments are not limited thereto, and the fan 13 may be provided as various types of fans to forcibly flow cold air.

The damper 14 may be accommodated in the cold air duct 80. The damper 14 may be disposed between the support member 130 and the rear body 120. For example, the damper 14 may be disposed between the second support member 132 and the second rear body 122. For example, the damper 14 may be disposed above the fan 13.

The damper 14 may be disposed on the first discharge flow path 340 to adjust an amount of cold air to be supplied to the refrigerating compartment 21. The damper 14 may be provided to open or close the first discharge flow path 340. The damper 14 may adjust an amount of cold air directing to the first discharge hole 320 by adjusting a degree of opening of the first discharge flow path 340. The refrigerator 1 may control the temperatures in the refrigerating compartment 21 and the freezing compartment 22 by controlling the operation of the damper 14.

For example, the damper 14 may include a damper case 141 and a damper plate 142 rotatably mounted in the damper case 141.

Figure 9:
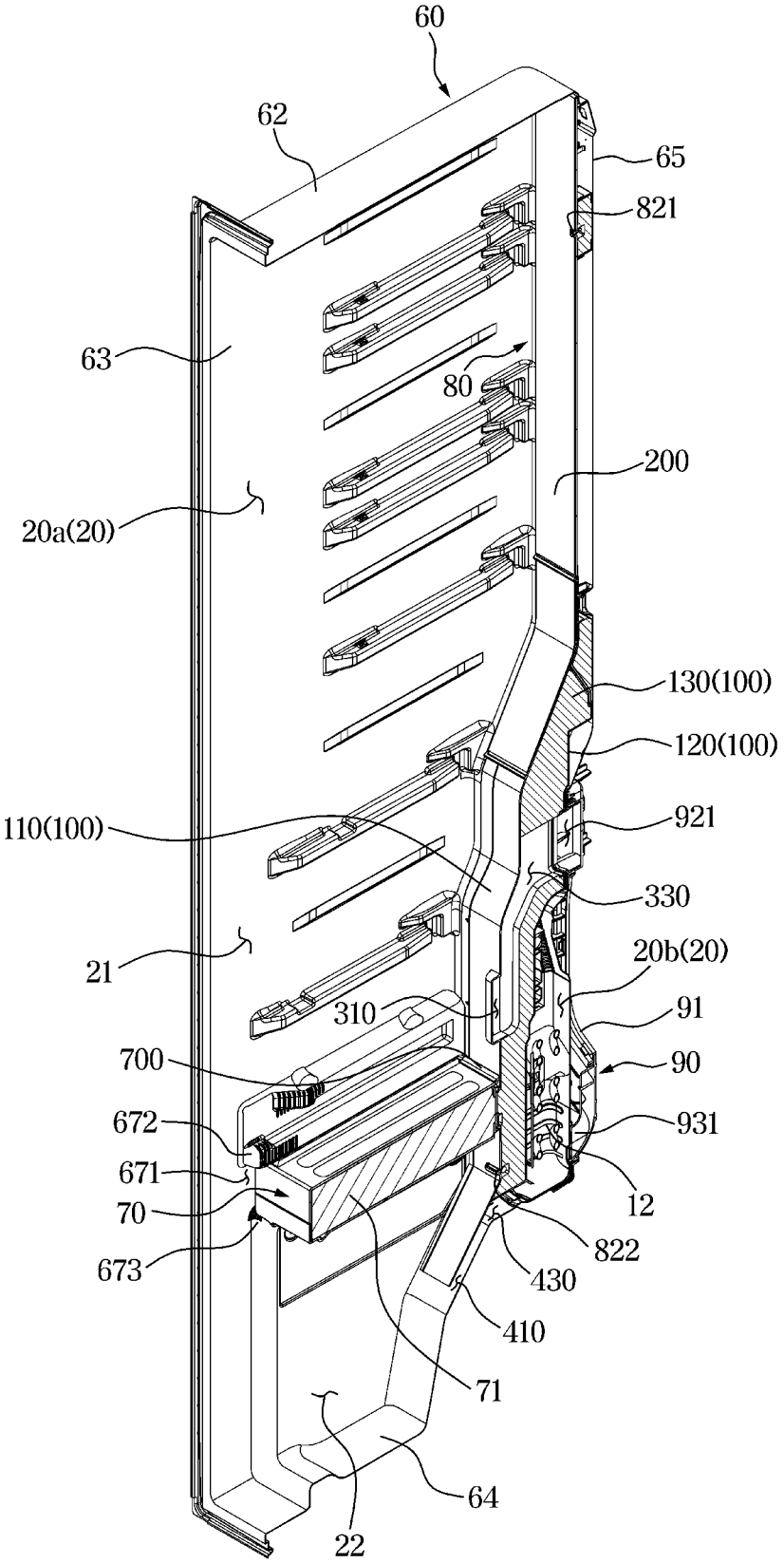
FIG. 9 is a perspective view taken by cutting along a line A-A' shown in FIG. 3.
Figure 10:
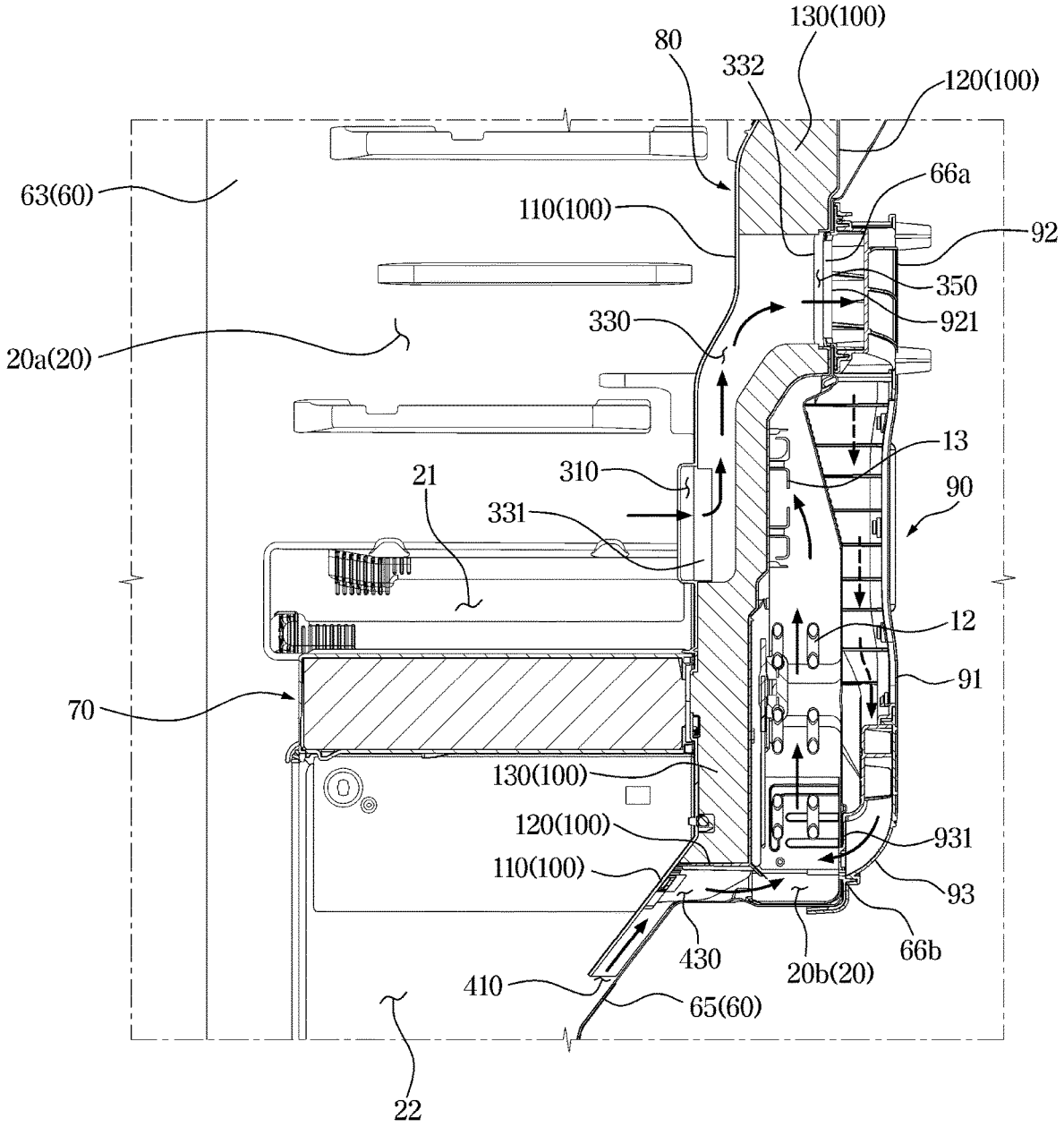
FIG. 10 is an enlarged view of a portion of the side cross-section shown in FIG. 9.

FIG. 9 is a perspective view taken by cutting along a line A-A' shown in FIG. 3. FIG. 10 is an enlarged view of a portion of the side cross-section shown in FIG. 9.

A flow of cold air to be returned from the storage compartment 20 will be described below with reference to FIGS. 9 and 10.

Cold air in the refrigerating compartment 21 may be introduced into the cold air duct 80 through the first return hole 310. The cold air introduced into the cold air duct 80 may flow along the first return flow path 330. The cold air introduced into the cold air duct 80 may be guided by the first return flow path 330. The cold air guided by the first return flow path 330 may flow to the cold air connector 90.

For example, the one side 331 of the first return flow path 330 may communicate with the first return hole 310. For example, the other side 332 of the first return flow path 330 may communicate with the guide hole 66*a* of the inner case 60. For example, the other side 332 of the first return flow path 330 may communicate with the inlet hole 921 of the cold air connector 90.

The cold air introduced into the cold air connector 90 may flow along a flow path formed inside the duct body 91. The cold air introduced into the cold air connector 90 may be guided by the duct body 91. The cold air guided by the duct body 91 may flow into the cooling chamber 20*b*.

For example, the inlet hole 921 of the cold air connector 90 may communicate with the first return flow path 330. For example, the outlet hole 931 of the cold air connector 90 may communicate with the cooling chamber 20*b*.

The cold air introduced into the cooling chamber 20*b* through the cold air connector 90 may be provided to exchange heat with the evaporator 12. The cold air heat-exchanged with the evaporator 12 may flow into the cold air duct 80 by an intake force of the fan 13. For example, the cold air generated by the evaporator 12 may move into the cold air duct 80 through the inlet hole 500 of the cold air duct 80.

However, unlike the above example, the first return flow path 330 may directly communicate with the cooling chamber 20*b*. That is, the cold air guided by the first return flow path 330 may flow directly into the cooling chamber 20*b* without passing through the cold air connector 90.

Generally, an inner case includes a refrigerating compartment inner case and a freezing compartment inner case. Thus, the inner case includes a refrigerating compartment formed by the refrigerating compartment inner case and a freezing compartment formed by the freezing compartment inner case. Therefore, a refrigerating compartment duct, which is disposed in the refrigerating compartment to supply cold air to the refrigerating compartment, and a freezing compartment duct, which is disposed in the freezing compartment to supply cold air to the freezing compartment, need to be provided separately. For example, in a case in which a single evaporator is disposed in the freezing compartment, the cold air returned from the refrigerating compartment needs to be delivered to the freezing compartment, and the cold air generated by the evaporator needs to be delivered to the refrigerating compartment. To this end, additional connecting parts may be required to connect the refrigerating compartment duct and the freezing compartment duct. Also, a separate return flow path may not be formed in the refrigerating compartment duct. Accordingly, an intake force for returning cold air in the refrigerating compartment may increase. As a result, cooling efficiency of a refrigerator may be improved.

In contrast, the inner case 60 may include the storage compartment 20 formed as a single space. The one cold air duct 80 may be provided in the storage compartment 20 forming one space. The storage compartment 20 may be partitioned into the refrigerating compartment 21 and the freezing compartment 22 by the partition 70 mounted in the inner case 60 and the cold air duct 80. The cold air duct 80 may not be divided into a refrigerating compartment duct and a freezing compartment duct, and may not include additional connecting parts. In addition, the cold air duct 80 may include the first return flow path 340 to return cold air in the refrigerating compartment 21. The first return flow path 340 may be provided to extend by a predetermined length inside the cold air duct 80. Accordingly, an intake area for drawing cold air in the refrigerating compartment 21 may be increased, and the cold air in the refrigerating compartment 21 may be returned more easily. As a result, the cooling efficiency of the refrigerator 1 may be improved.

Cold air in the freezing compartment 22 may be introduced into the cold air duct 80 through the second return hole 410. The cold air introduced into the cold air duct 80 may flow along the second return flow path 430. The cold air introduced into the cold air duct 80 may be guided by the second return flow path 430. The cold air guided by the second return flow path 430 may flow into the cooling chamber 20*b*.

The cold air duct 80 may form the second return hole 410. The cold air duct 80 may form the second return hole 410 as the cold air duct 80 is mounted in the inner case 60. For example, the second return hole 410 may be formed between an end of the front body 110 of the cold air duct 80 and an inner wall of the inner case 60. For example, the second return hole 410 may be formed between the end of the front body 110 of the cold air duct 80 and the rear wall 65 of the inner case 60.

The cold air duct 80 may form the second return flow path 430. The cold air duct 80 may form the second return flow path 430 as the cold air duct 80 is mounted in the inner case 60. For example, the second return flow path 430 may be formed between the cold air duct 80 and the inner case 60. For example, the second return flow path 430 may be formed between the cold air duct 80 and the rear wall 65 of the inner case 60. For example, one portion of the second return flow path 430 may be formed between the front body 110 and the rear wall 65 of the inner case 60. For example, the other portion of the second return flow path 430 may be formed between the rear body 120 and the rear wall 65 of the inner case 60.

For example, the second return flow path 430 may extend from the second return hole 410 to the cooling chamber 20*b*. For example, one side of the second return flow path 430 may communicate with the second return hole 410. For example, the other side of the second return flow path 430 may communicate with the cooling chamber 20*b*.

The cold air introduced into the cooling chamber 20*b* through the second return flow path 430 may exchange heat with the evaporator 12. The cold air heat-exchanged with the evaporator 12 may flow into the cold air duct 80 by the intake force of the fan 13. For example, the cold air generated by the evaporator 12 may move into the cold air duct 80 through the inlet hole 500 of the cold air duct 80.

The cold air duct 80 may easily return cold air inside the storage compartment 20 by having a plurality of the return flow paths 330 and 430. In a case in which the partition 70 partitions the storage compartment 20 into the refrigerating compartment 21 and the freezing compartment 22, the cold air duct 80 may draw cold air in the refrigerating compartment 21 and cold air in the freezing compartment 22 at a time. In a case in which the partition 70 does not partition the storage compartment 20 into the refrigerating compartment 21 and the freezing compartment 22, the cold air duct 80 may draw cold air inside the storage compartment 20 from a plurality of points. Accordingly, the intake force for returning cold air from the storage compartment 20 may increase, and the cooling efficiency of the refrigerator 1 may be improved.

Figure 11:
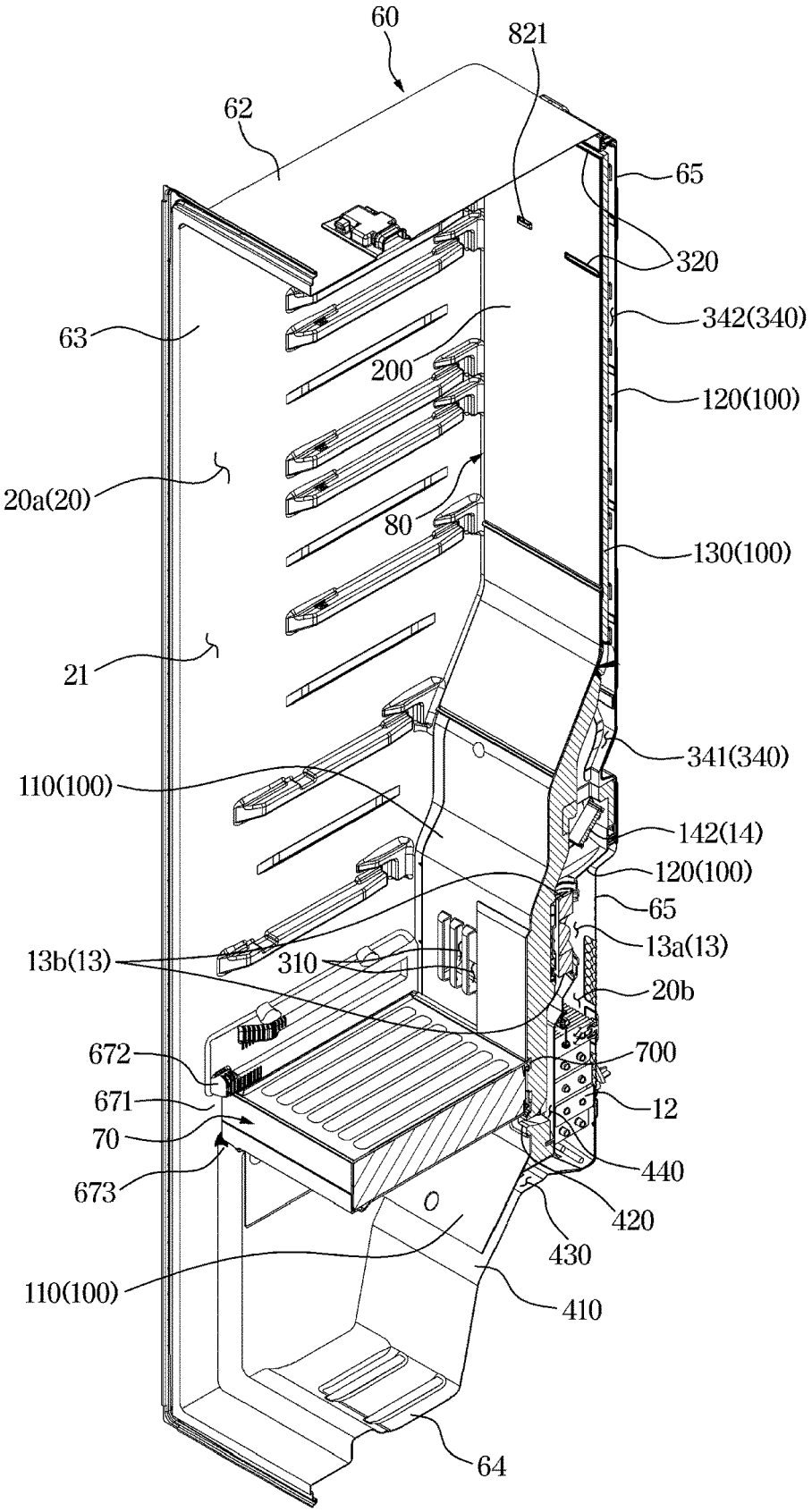
FIG. 11 is a perspective view taken by cutting along a line B-B' shown in FIG. 3.
Figure 12:
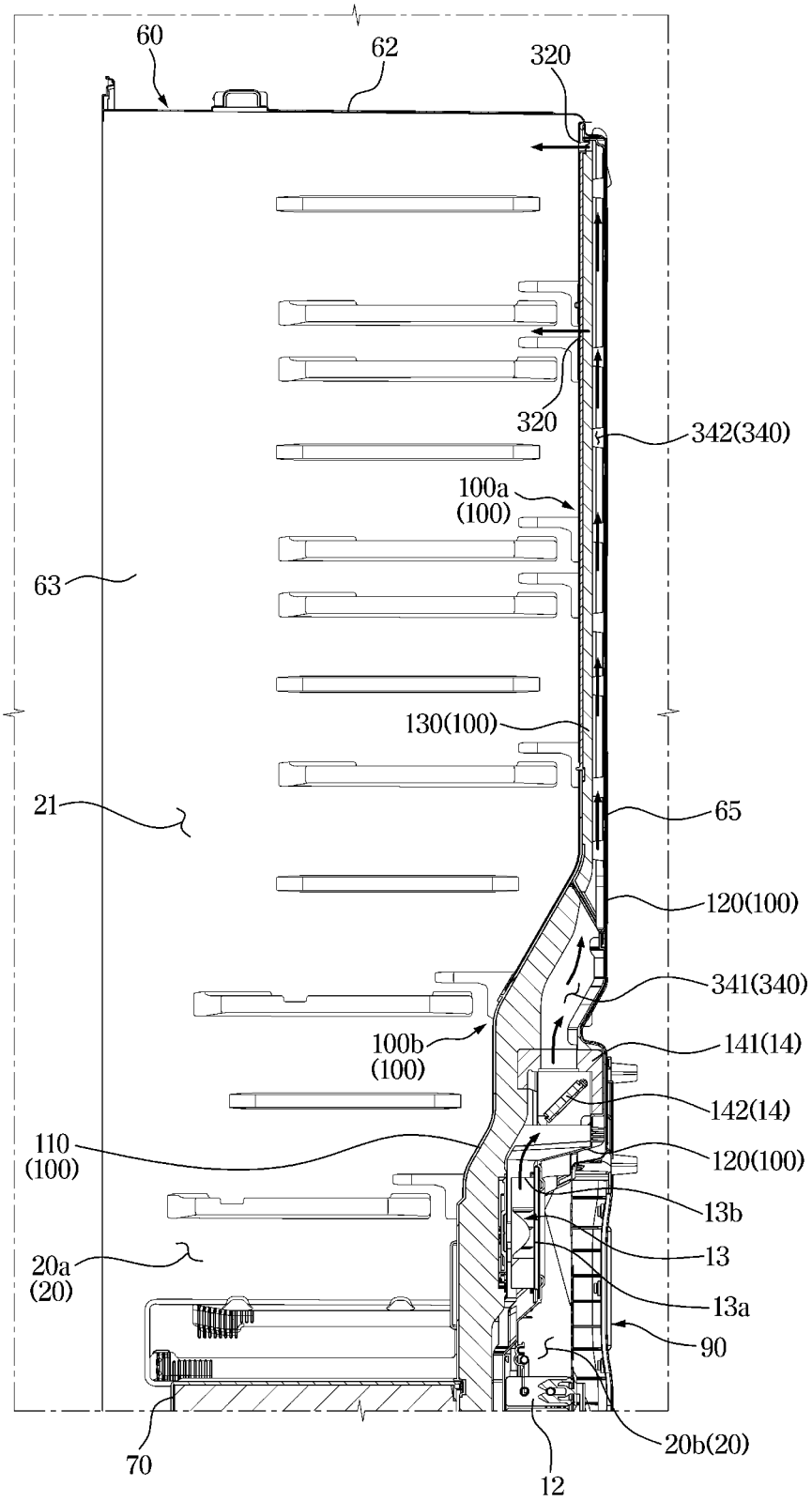
FIG. 12 is an enlarged view of one portion of the side cross-section shown in FIG. 11.
Figure 13:
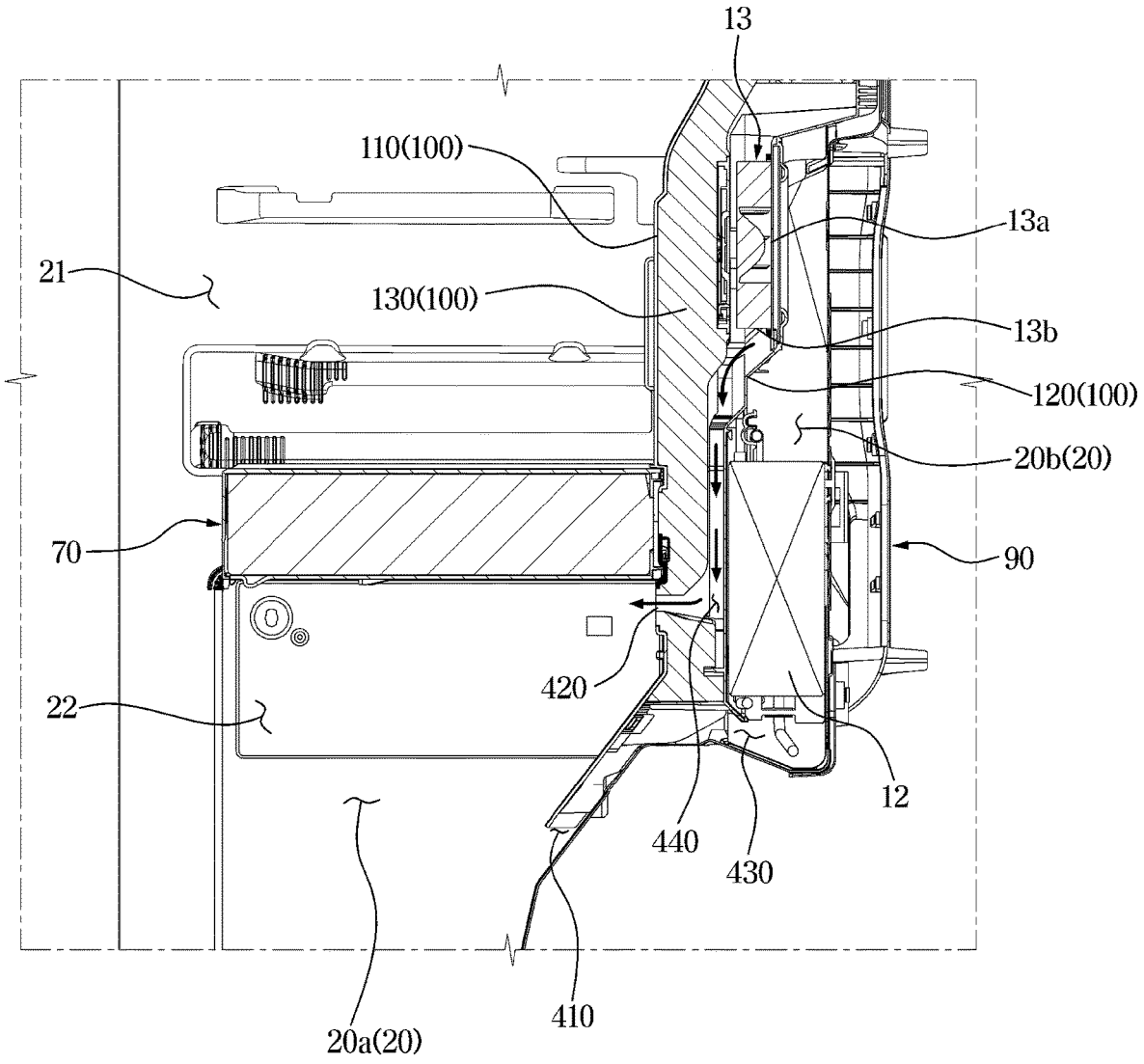
FIG. 13 is an enlarged view of the other portion of the side cross-section shown in FIG. 11.

FIG. 11 is a perspective view taken by cutting along a line B-B' shown in FIG. 3. FIG. 12 is an enlarged view of one portion of the side cross-section shown in FIG. 11. FIG. 13 is an enlarged view of the other portion of the side cross-section shown in FIG. 11.

A flow of cold air to be supplied to the storage compartment 20 will be described below with reference to FIGS. 11 to 13.

Referring to FIGS. 11 and 12, the cold air discharged from the fan 13 may flow along the first discharge flow path 340. The cold air discharged from the fan 13 may be guided by the first discharge flow path 340. The cold air guided by the first discharge flow path 340 may flow toward the first discharge hole 320. The cold air flowing on the first discharge flow path 340 may be supplied to the refrigerating compartment 21 through the first discharge hole 320.

For example, one side of the first discharge flow path 340 may communicate with the discharge side 13*b* of the fan 13. For example, the other side of the first discharge flow path 340 may communicate with the first discharge hole 320.

Referring to FIGS. 11 and 13, the cold air discharged from the fan 13 may flow along the second discharge flow path 440. The cold air discharged from the fan 13 may be guided by the second discharge flow path 440. The cold air guided by the second discharge flow path 440 may flow toward the second discharge hole 420. The cold air flowing on the second discharge flow path 440 may be supplied to the freezing compartment 22 through the second discharge hole 420.

For example, one side of the second discharge flow path 440 may communicate with the discharge side 13*b* of the fan 13. For example, the other side of the second discharge flow path 440 may communicate with the second discharge hole 420.

As described above, the one cold air duct 80 may be provided in the storage compartment 20 forming one space. That is, the cold air duct 80 is not divided into a refrigerating compartment duct and a freezing compartment duct, and additional components to connect the refrigerating compartment inner case and the freezing compartment inner case are also unnecessary. Accordingly, the refrigerator 1 may supply cold air to both the refrigerating compartment 21 and the freezing compartment 22 through the one cold air duct 80.

The cold air duct 80 may easily supply cold air to the storage compartment 20 by having a plurality of the discharge flow paths 340 and 440. In the case in which the partition 70 partitions the storage compartment 20 into the refrigerating compartment 21 and the freezing compartment 22, the cold air duct 80 may supply cold air to the refrigerating compartment 21 and the freezing compartment 22 at a time. In the case in which the partition 70 does not partition the storage compartment 20 into the refrigerating compartment 21 and the freezing compartment 22, the cold air duct 80 may discharge cold air to the storage compartment 20 from the plurality of points. Accordingly, a discharge force for supplying cold air to the storage compartment 20 may increase. As a result, the cooling efficiency of the refrigerator 1 may be improved.

Figure 14:
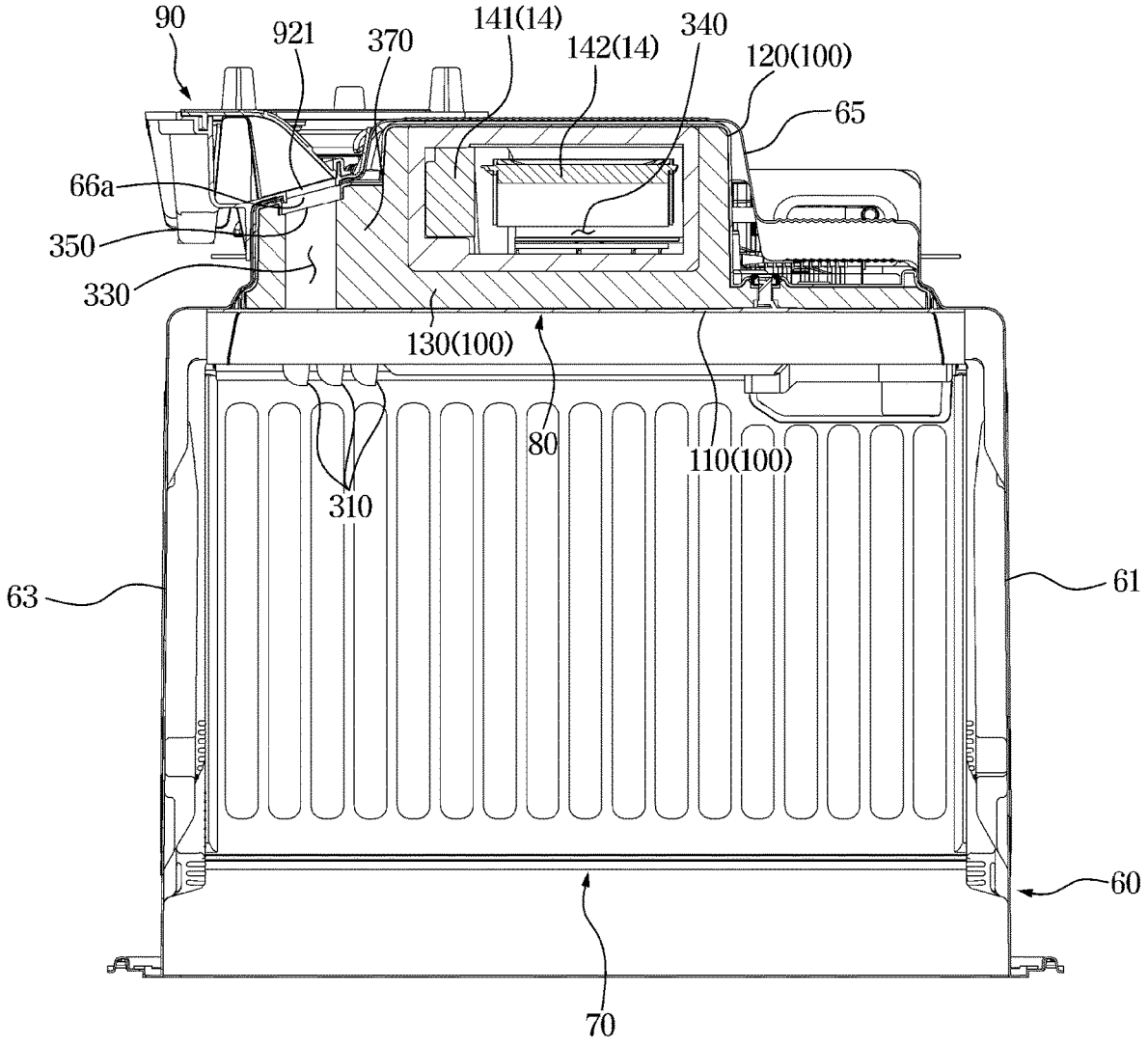
FIG. 14 is a plan view taken by cutting along a line C-C' shown in FIG. 3.

FIG. 14 is a plan view taken by cutting along a line C-C' shown in FIG. 3.

Referring to FIG. 14, the cold air duct 80 may include a wall 370. The wall 370 may be provided to partition the first return flow path 330 and the first discharge flow path 340. The wall 370 may be formed between the first return flow path 330 and the first discharge flow path 340. The wall 370 may be provided such that cold air flowing in the first return flow path 330 and cold air flowing in the first discharge flow path 340 do not mix with each other. The wall 370 may prevent heat exchange between cold air flowing in the first return flow path 330 and cold air flowing in the first discharge flow path 340. Accordingly, a temperature of cold air flowing in the first discharge flow path 340 may be kept, and the cooling efficiency of the refrigerator 1 may not be deteriorated. For example, wall 370 may be formed on support member 130. For example, the wall 370 may be formed on the second support member 132.

Figure 15:
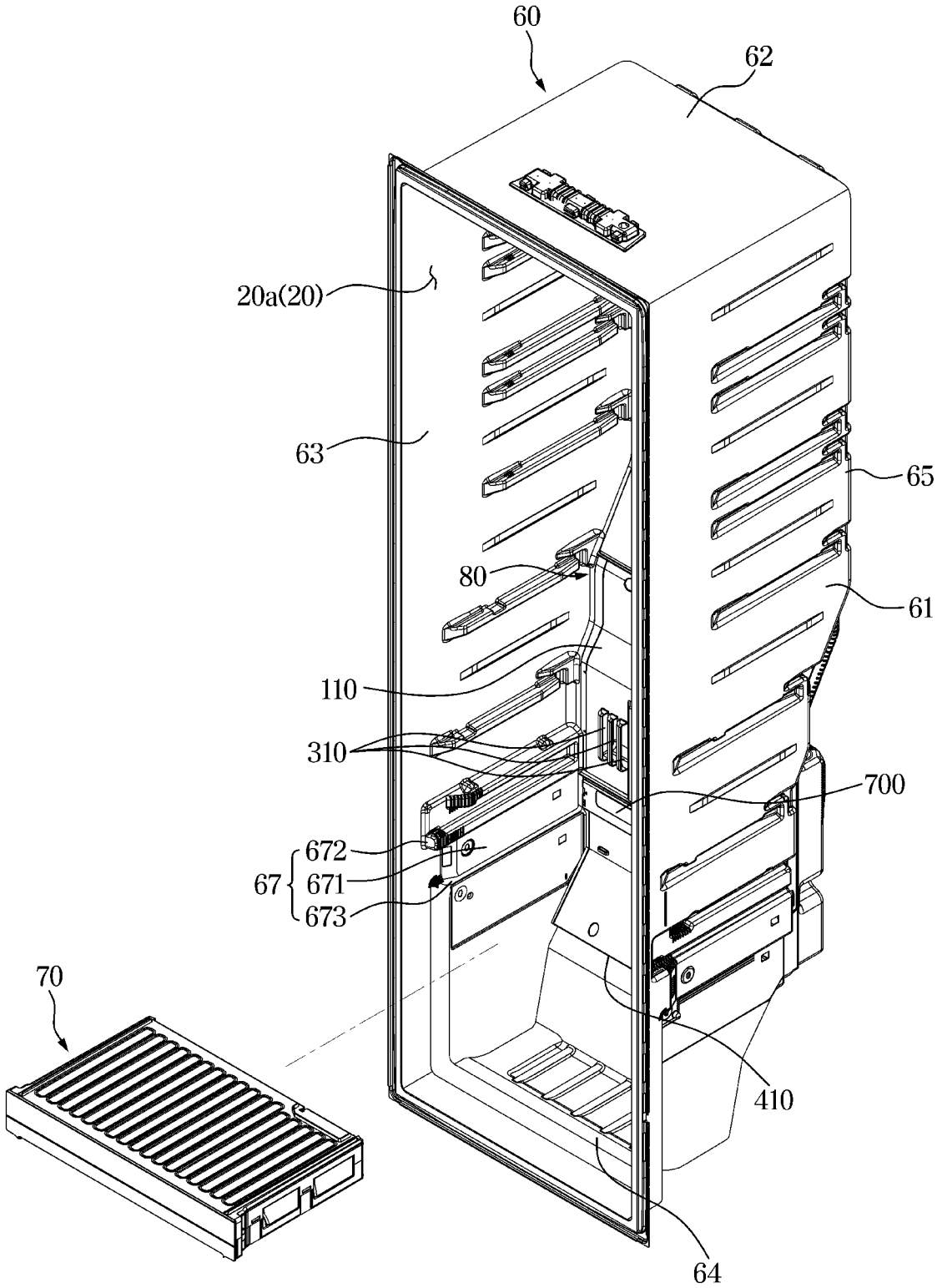
FIG. 15 is a view illustrating that a partition is detachable from an inner case and a cold air duct according to an embodiment.
Figure 16:
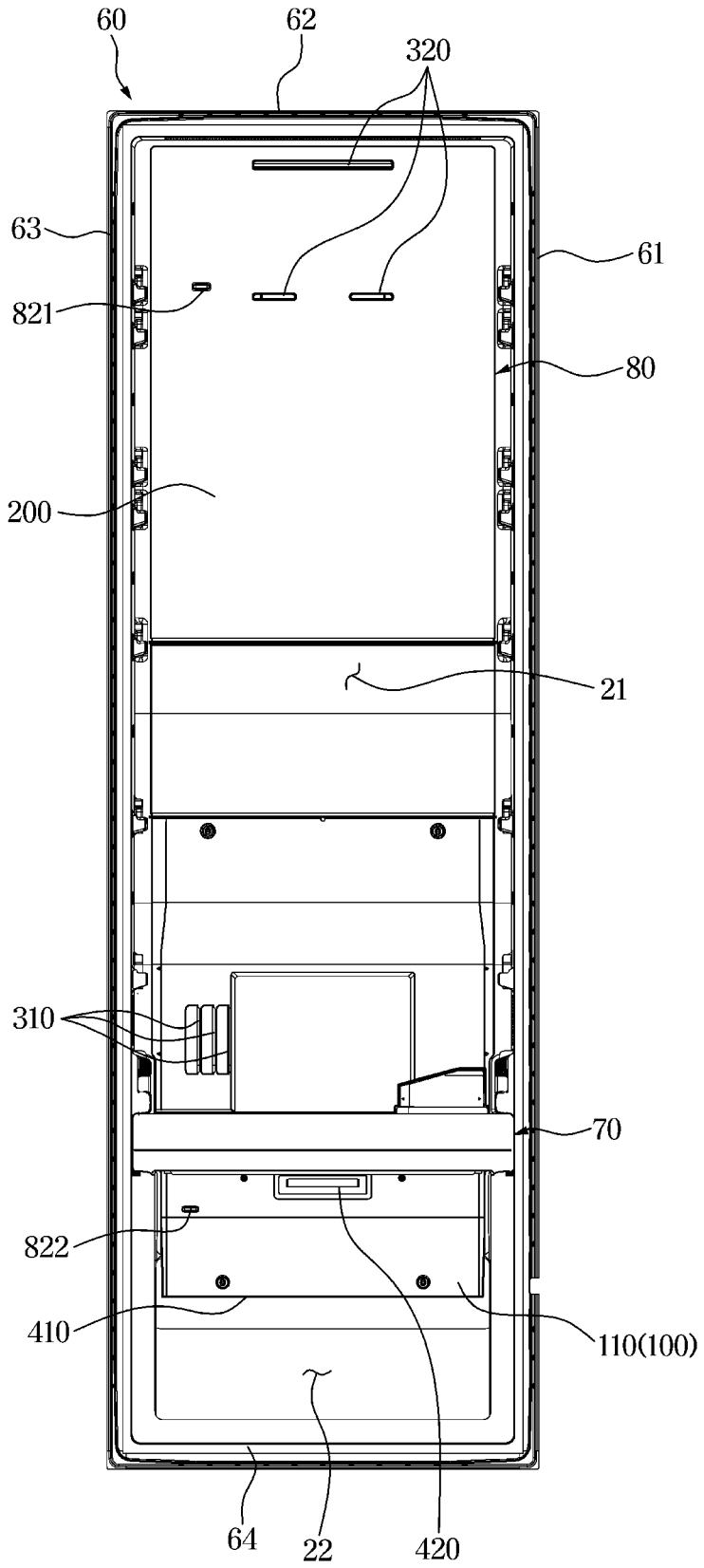
FIG. 16 is a front view illustrating that the partition is mounted in the inner case and the cold air duct according to an embodiment.
Figure 17:
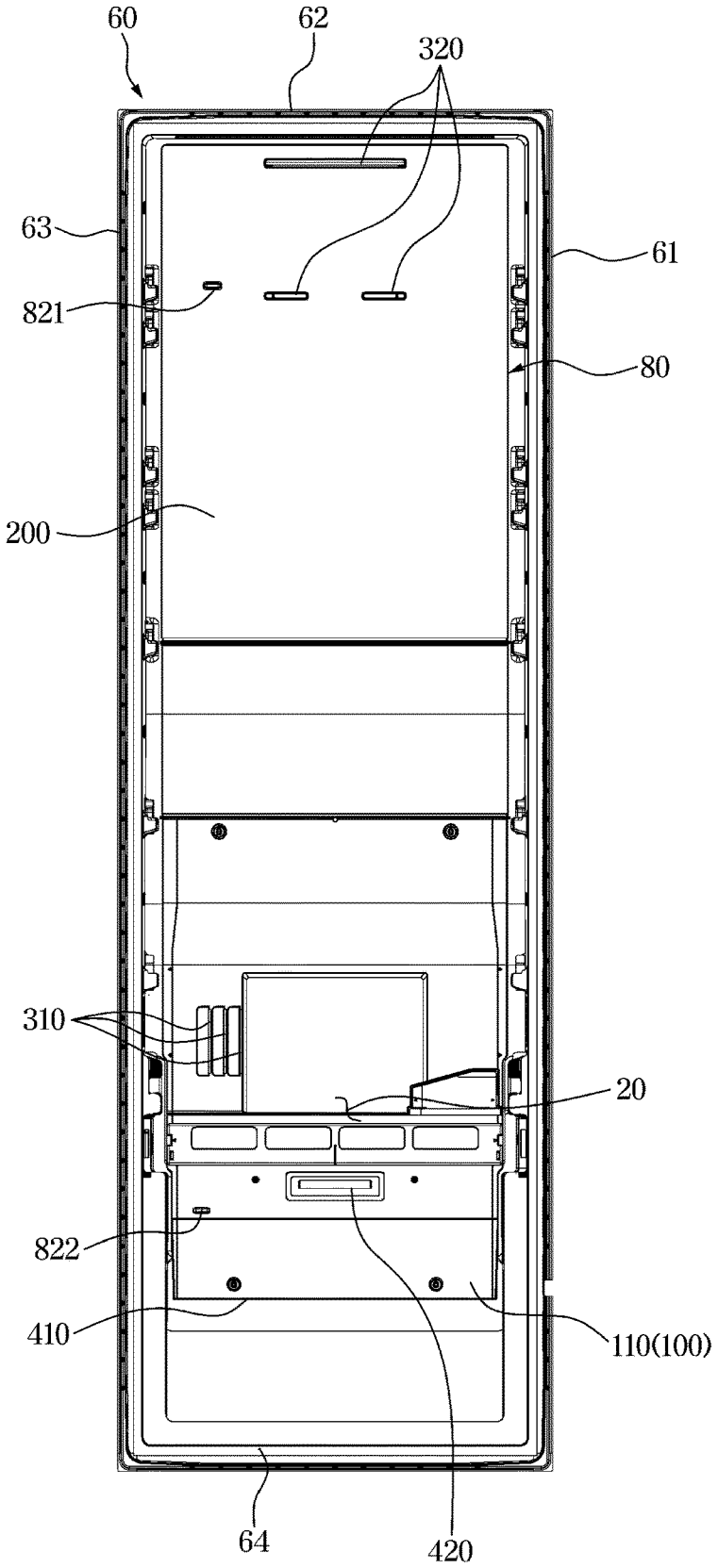
FIG. 17 is a front view illustrating that the partition is separated from the inner case and the cold air duct according to an embodiment.

FIG. 15 is a view illustrating that a partition is detachable from an inner case and a cold air duct according to an embodiment. FIG. 16 is a front view illustrating that the partition is mounted in the inner case and the cold air duct according to an embodiment. FIG. 17 is a front view illustrating that the partition is separated from the inner case and the cold air duct according to an embodiment.

Referring to FIG. 15, the partition 70 may be detachably mounted in the inner case 60. For example, the partition 70 may be detachably coupled to at least one of the side walls 61 and 63 of the inner case 60. The partition 70 may be detachably mounted in the cold air duct 80. The partition 70 may be detachably coupled to the front of the cold air duct 80. For example, the partition 70 may be detachably coupled to the front body 110.

Referring to FIG. 16, by being mounted in the inner case 60 and the cold air duct 80, the partition 70 may partition the storage compartment 20 into the first storage compartment 21 and the second storage compartment 22. For example, the partition 70 may be provided to partition the storage compartment 20 in the up-down direction.

For example, in a case in which the partition 70 is mounted in the inner case 60 and/or the cold air duct 80, the first storage compartment 21 may be implemented as a refrigerating compartment, and the second storage compartment 22 may be implemented as a freezing compartment. The first storage compartment 21 may be implemented as a refrigerating compartment having a first temperature, and the second storage compartment 22 may be implemented as a refrigerating compartment having a second temperature. However, this is only exemplary, the first storage compartment 21 may be implemented as a freezing compartment, and the second storage compartment 22 may be implemented as a refrigerating compartment. The first storage compartment 21 may be implemented as a freezing compartment having a third temperature, and the second storage compartment 22 may be implemented as a freezing compartment having a fourth temperature. The first storage compartment 21 and the second storage compartment 22 may be implemented to have the same temperature.

Referring to FIG. 17, the partition 70 may be separated from the inner case 60 so that the inside of the inner case 60 is provided as a refrigerating compartment or a freezing compartment. The partition 70 may be separated from the cold air duct 80 so that the inside of the inner case 60 is provided as a refrigerating compartment or a freezing compartment. That is, in a case in which the partition 70 is not mounted in the refrigerator 1, the storage compartment 20 may be provided as a refrigerating compartment or a freezing compartment. In a case in which the partition 70 is not mounted in the inner case 60 and the cold air duct 80, the storage compartment 20 may be provided as a single space and may be implemented as a refrigerating compartment or a freezing compartment depending on a temperature therein.

In a case in which the partition 70 is separated from the inner case 60 and/or the cold air duct 80, the cold air duct 80 may return cold air in the storage compartment 20 through the first return hole 310 and the second return hole 410. The cold air returned through the first return hole 310 may be guided to the evaporator 12 along the first return flow path 330. The cold air returned through the second return hole 410 may be guided to the evaporator 12 along the second return flow path 430. That is, the cold air inside the storage compartment 20 may be drawn at a time from a plurality of points. Therefore, return efficiency of cold air in the storage compartment 20 may be increased.

In the case in which the partition 70 is separated from the inner case 60 and/or the cold air duct 80, the cold air duct 80 may guide the cold air generated from the evaporator 12 through the first discharge flow path 340 and the second discharge flow path 440. The cold air guided by the first discharge flow path 340 may be discharged to the storage compartment 20 through the first discharge hole 320. The cold air guided by the second discharge flow path 440 may be discharged to the storage compartment 20 through the second discharge hole 420. That is, the cold air generated by the evaporator 12 may be supplied to the inside of the storage compartment 20 at a time from a plurality of points. Therefore, supply efficiency of cold air to the storage compartment 20 may be increased.

Referring to FIGS. 16 and 17, the storage compartment 20 may be implemented as a refrigerating compartment, a freezing compartment, or a refrigerating compartment and a freezing compartment partitioned from each other. The user may implement the storage compartment 20 in various ways depending on use. Because the usability of the storage compartment 20 is excellent, satisfaction of the user may be improved.

Hereinafter, for convenience of description, an example in which the first storage compartment 21 is implemented as the refrigerating compartment 21 and the second storage compartment 22 is implemented as the freezing compartment 22 will be described.

In the case in which the partition 70 is mounted in the inner case 60 and/or the cold air duct 80, the storage compartment 20 may be partitioned into the refrigerating compartment 21 and the freezing compartment 22 provided below the refrigerating compartment 21.

The partition 70 may be disposed between the first return hole 310 and the second discharge hole 420. With this arrangement, the cold air circulated through the refrigerating compartment 21 may be returned through the first return hole 310, the cold air generated by the evaporator 12 may be discharged to the freezing compartment 22 through the second discharge hole 420. However, the arrangement of the partition 70 as described above may be applied in a case in which the first discharge hole 320 is disposed above the first return hole 310 and the second discharge hole 420 is disposed above the second return hole 410.

The partition 70 may be provided to be movable between the first return hole 310 and the second discharge hole 420. For example, the partition 70 may be movable up and down between the first return hole 310 and the second discharge hole 420. For example, the partition 70 may be provided to be slidable in the up-down direction with respect to the inner case 60 and/or the cold air duct 80.

As a mounting position of the partition 70 changes, a ratio of the refrigerating compartment 21 and the freezing compartment 22 may change. For example, in a case in which the partition 70 moves upward from an initial position (see FIG. 16), a size of the refrigerating compartment 21 may decrease and a size of the freezing compartment 22 may increase. For example, in a case in which the partition 70 moves downward from the initial position (see FIG. 16), the size of the refrigerating compartment 21 may increase and the size of the freezing compartment 22 may decrease.

In general, an inner case may be divided into a refrigerating compartment inner case and a freezing compartment inner case. In addition, an inner case may include an intermediate wall to be divided into a refrigerating compartment inner case and a freezing compartment inner case. A ratio of a refrigerating compartment and a freezing compartment is fixed, and the intermediate wall may be embedded in an insulator. Accordingly, the refrigerating and freezing compartments may only be used in an initially manufactured sizes. That is, the user may not adjust the ratio of the refrigerating and freezing compartments.

In contrast, the user may adjust the ratio of the refrigerating compartment 21 and the freezing compartment 22 by adjusting the position of the partition 70. Therefore, the user may set the ratio of the refrigerating compartment 21 and the freezing compartment 22 as desired. For example, when there are more foods to be stored in the refrigerated state than foods to be stored in the frozen state, a space of the refrigerating compartment 21 may be secured by reducing a space of the freezing compartment 22. For example, when there are more foods to be stored in the frozen state than foods to be stored in the refrigerated state, the space of the freezing compartment 22 may be secured by reducing the space of the refrigerating compartment 21. Therefore, convenience of use of the refrigerator 1 may be improved.

Figure 18:
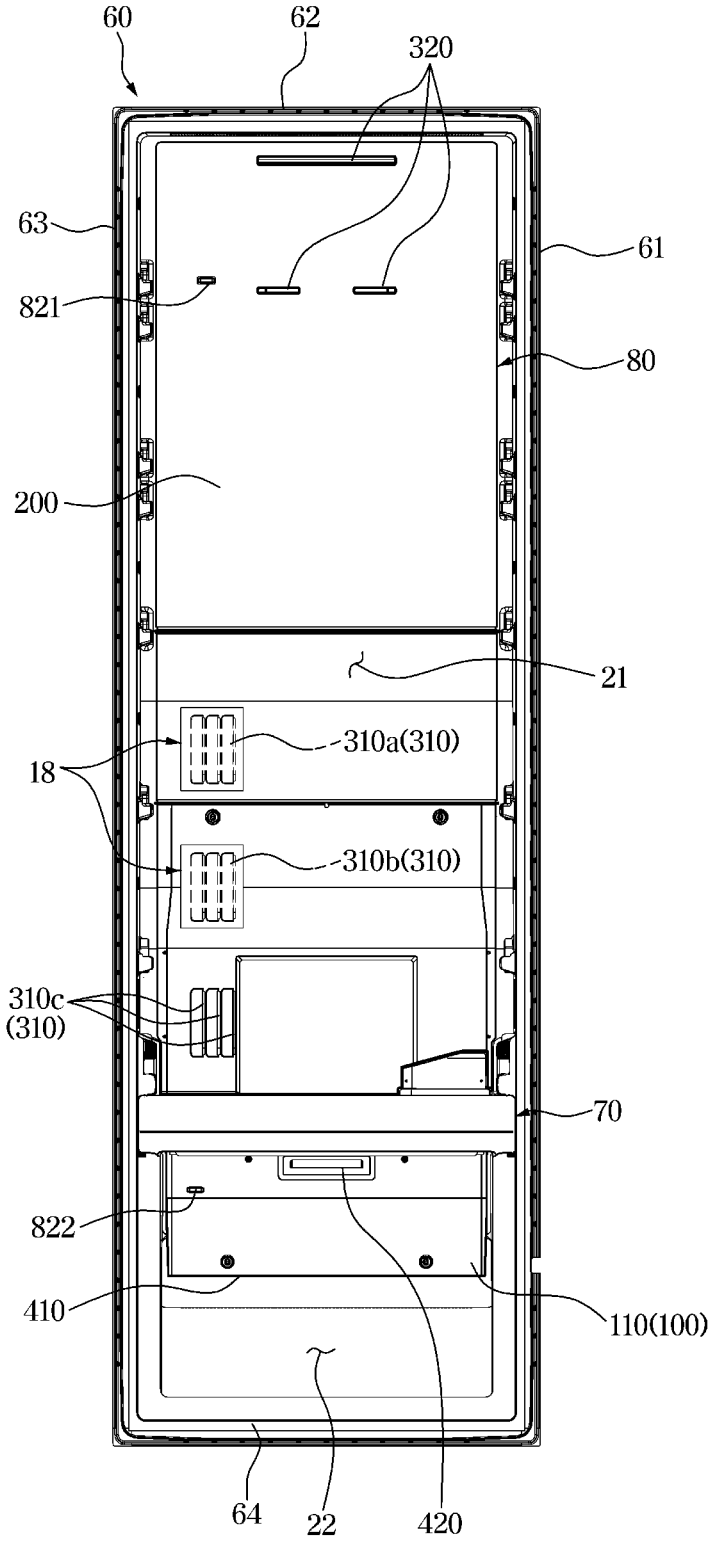
FIG. 18 is a front view illustrating that the refrigerator includes a plurality of refrigerating compartment return holes according to an embodiment.
Figure 19:
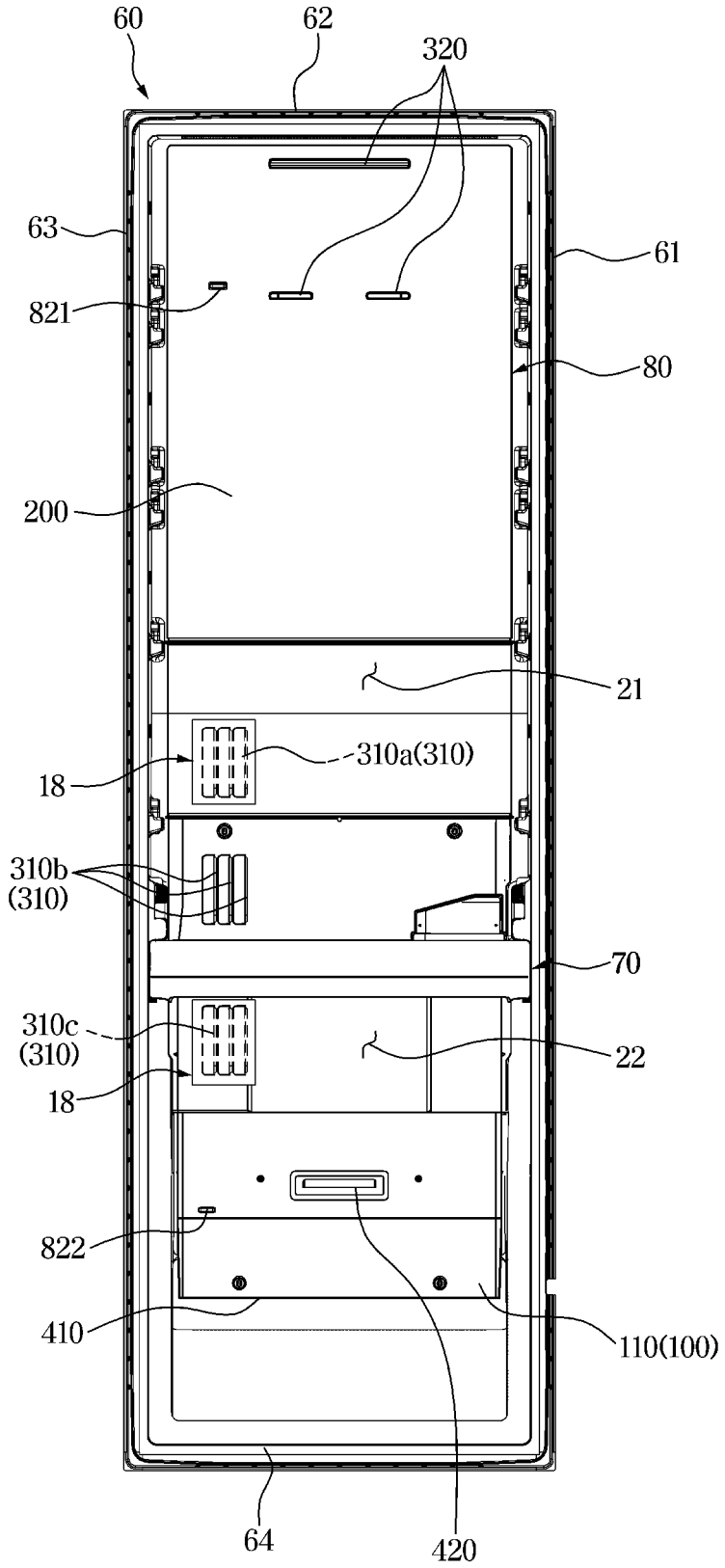
FIG. 19 is a front view illustrating that the partition shown in FIG. 18 is moved.

FIG. 18 is a front view illustrating that the refrigerator includes a plurality of refrigerating compartment return holes according to an embodiment. FIG. 19 is a front view illustrating that the partition shown in FIG. 18 is moved.

An example of adjusting the ratio of the refrigerating compartment 21 and the freezing compartment 22 of the refrigerator 1 will be described below with reference to FIGS. 18 and 19.

The refrigerator 1 may include a plurality of first return holes 310*a*, 310*b*, and 310*c*. The plurality of first return holes 310*a*, 310*b*, and 310*c* may be arranged substantially in the up-down direction. The plurality of first return holes 310*a*, 310*b*, and 310*c* may be arranged substantially along the height direction of the storage compartment 20. For example, the plurality of first return holes 310*a*, 310*b*, and 310*c* may include the 1*a* return hole 310*a*, the 1*b* return hole 310*b* positioned below the 1*a* return hole 310*a*, and the 1*c* return hole 310*c* positioned below the 1*b* return hole 310*b*. Each of the plurality of first return holes 310*a*, 310*b*, and 310*c* may communicate with the first return flow path 330.

The partition 70 may be moved substantially in the up-down direction. The partition 70 may be moved substantially along the height direction of the storage compartment 20. The partition 70 may be provided to be positioned below at least one of the plurality of first return holes 310*a*, 310*b*, and 310*c*.

A first return hole positioned below the partition 70 among the plurality of first return holes 310*a*, 310*b*, and 310*c* may be covered by a return hole cover 18.

For example, referring to FIG. 18, the plurality of first return holes 310*a*, 310*b*, and 310*c* may be positioned above the partition 70. That is, all of the plurality of first return holes 310*a*, 310*b*, and 310*c* may be disposed in the refrigerating compartment 21. The plurality of first return holes 310*a*, 310*b*, and 310*c* may not be covered by the return hole cover 18. However, the rest of the plurality of first return holes 310*a*, 310*b*, and 310*c* except for the first return hole positioned farthest from the first discharge hole 320 may be covered by the return hole cover 18. For example, the 1*a* return hole 310*a* and the 1*b* return hole 310*b* except for the 1*c* return hole 310*c* may be covered by the return hole cover 18. Therefore, the cold air discharged through the first discharge hole 320 may circulate through the refrigerating compartment 21 for a predetermined time without being immediately returned through the 1*a* return hole 310*a* and the 1*b* return hole 310*b*. The cold air circulated through the refrigerating compartment 21 may be introduced into the cold air duct 80 through the first return hole 310*c*.

For example, referring to FIG. 19, some of the plurality of first return holes 310*a*, 310*b*, and 310*c* may be positioned below the partition 70. That is, some of the plurality of first return holes 310*a*, 310*b*, and 310*c* may be disposed in the freezing compartment 22. A first return hole positioned below the partition 70 among the plurality of first return holes 310*a*, 310*b*, and 310*c* may be provided not to communicate with the freezing compartment 22 by being covered by the return hole cover 18. For example, the 1*c* return hole 310*c* may be covered by the return hole cover 18. For example, the first return hole 310*a* and the first return hole 310*b* may not be covered by the return hole cover 18. However, the 1*a* return hole 310*a*, except for the 1*b* return hole 310*b* positioned farthest from the first discharge hole 310 among the first return holes positioned above the partition 70, may be covered by the return hole cover 18. Therefore, the cold air discharged through the first discharge hole 320 may circulate through the refrigerating compartment 21 for the predetermined time without being immediately returned through the 1*a* return hole 310*a*. The cold air circulated through the refrigerating compartment 21 may be introduced into the cold air duct 80 through the 1*b* return hole 310*b*.

In a case in which the partition 70 is positioned between the 1*a* return hole 310*a* and the 1*b* return hole 310*b*, the 1*b* return hole 310*b* and the 1*c* return hole 310*c* may be covered by the return hole cover 18 so as not to communicate with the freezing compartment 22.

Although the drawings illustrate that the plurality of first return holes 310 includes the 1*a* return holes 310*a*, the 1*b* return holes 310*b*, and the 1*c* return holes 310*c*, which are arranged in the up-down direction, embodiments are not limited thereto. For example, it is sufficient as long as the plurality of first return holes 310 is provided as two or more, and the number of first return holes is not limited. For example, the plurality of first return holes 310 may be arranged in the left-right direction, and in the case, the first return flow path 330 may also extend in the left-right direction to communicate with each of the plurality of first return holes 310.

Figure 20:
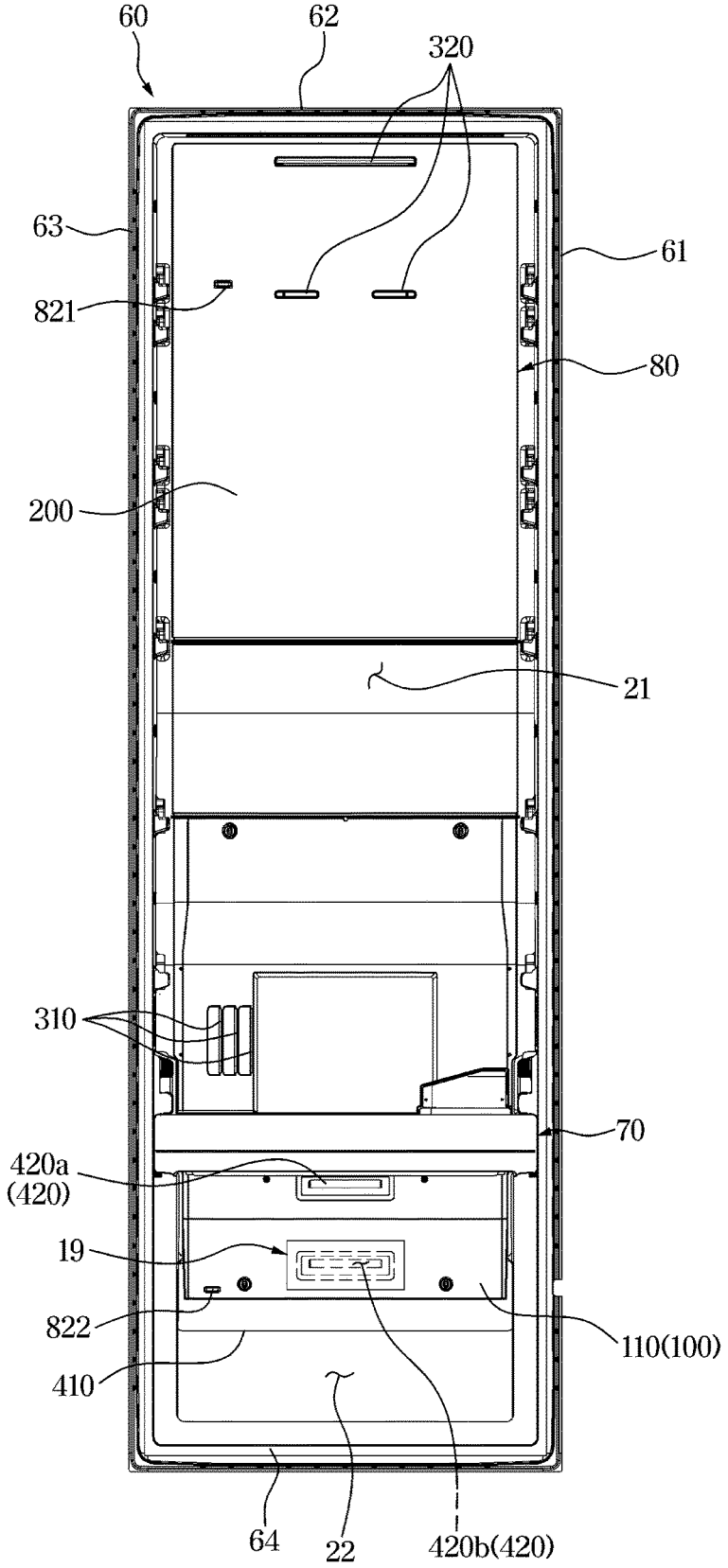
FIG. 20 is a front view illustrating the refrigerator includes a plurality of freezing compartment discharge holes according to an embodiment.
Figure 21:
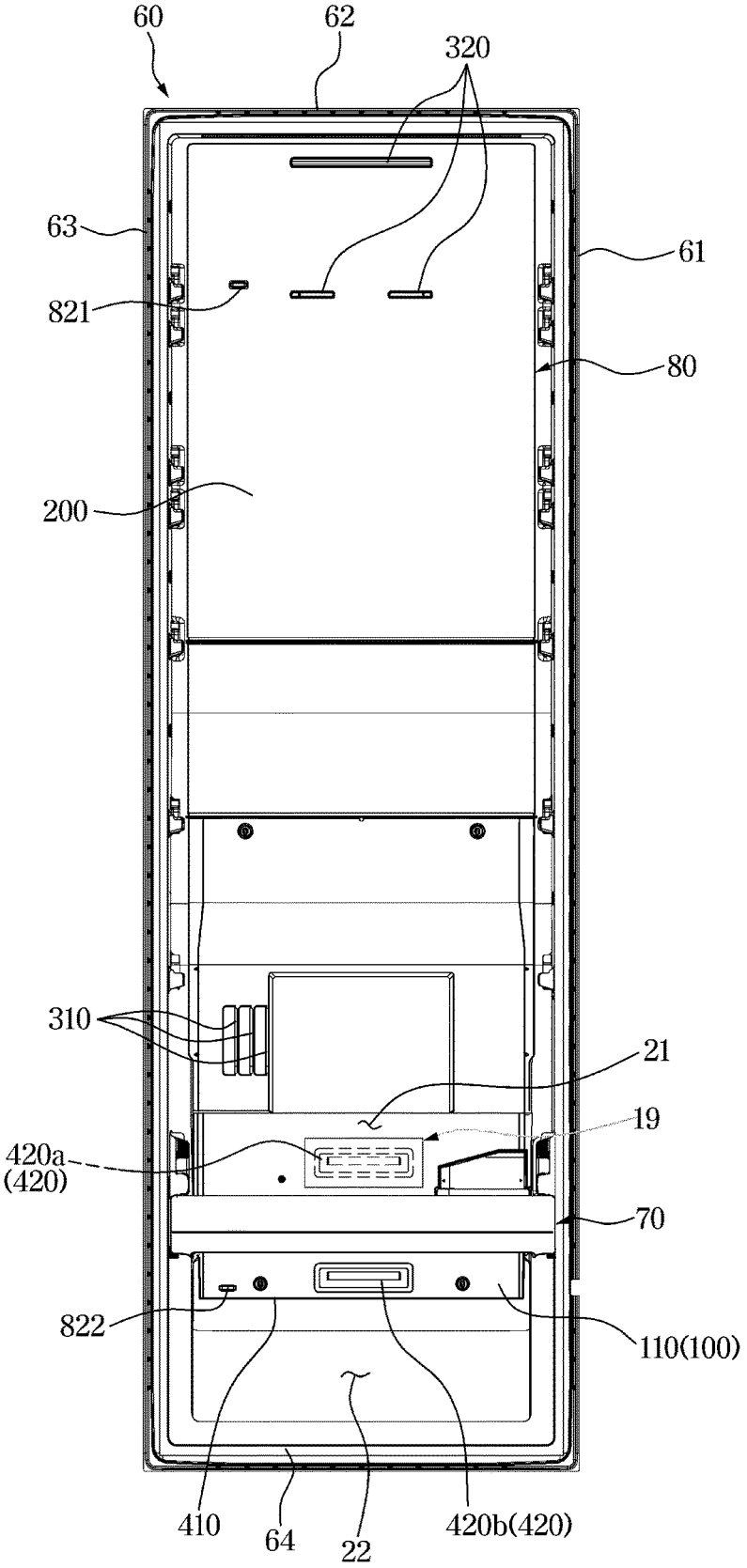
FIG. 21 is a front view illustrating that the partition shown in FIG. 20 is moved.

FIG. 20 is a front view illustrating the refrigerator includes a plurality of freezing compartment discharge holes according to an embodiment. FIG. 21 is a front view illustrating that the partition shown in FIG. 20 is moved.

An example of adjusting the ratio of the refrigerating compartment 21 and the freezing compartment 22 of the refrigerator 1 will be described below with reference to FIGS. 20 and 21.

The refrigerator 1 may include a plurality of second discharge holes 420*a* and 420*b*. The plurality of second discharge holes 420*a* and 420*b* may be arranged substantially in the up-down direction. The plurality of second discharge holes 420*a* and 420*b* may be arranged substantially along the height direction of the storage compartment 20. For example, the plurality of second discharge holes 420*a* and 420*b* may include the 2*a* discharge hole 420*a* and the 2*b* discharge hole 420*b* positioned below the 2*a* discharge hole 420*a*. Each of the plurality of second discharge holes 420*a* and 420*b* may communicate with the second return flow path 430.

The partition 70 may be moved substantially in the up-down direction. The partition 70 may be moved substantially along the height direction of the storage compartment 20. The partition 70 may be provided to be positioned above at least one of the plurality of second discharge holes 420*a* and 420*b*.

A second discharge hole positioned above the partition 70 among the plurality of second discharge holes 420*a* and 420*b* may be covered by the discharge hole cover 19.

For example, referring to FIG. 20, the plurality of second discharge holes 420*a* and 420*b* may be positioned below the partition 70. That is, all of the plurality of second discharge holes 420*a* and 420*b* may be disposed in the freezing compartment 22. The plurality of second discharge holes 420*a* and 420*b* may not be covered by the discharge hole cover 19. However, the rest of the plurality of second discharge holes 420*a* and 420*b* except for the second discharge hole positioned farthest from the second return hole 410 may be covered by the discharge hole cover 19. For example, the 2*b* discharge hole 420*b* except for the 2*a* discharge hole 420*a* may be covered by the discharge hole cover 19. Therefore, the cold air generated by the evaporator 12 may be discharged into the freezing compartment 22 through the 2*a* discharge hole 420*a* without being discharged through the 2*b* discharge hole 420*b*. That is, the second discharge hole 420 and the second return hole 410 may be disposed far apart. Accordingly, the cold air discharged through the second discharge hole 420*a* may circulate through the freezing compartment 22 for a predetermined time.

For example, referring to FIG. 21, some of the plurality of second discharge holes 420*a* and 420*b* may be positioned above the partition 70. That is, some of the plurality of second discharge holes 420*a* and 420*b* may be disposed in the refrigerating compartment 21. A second discharge hole positioned above the partition 70 among the plurality of second discharge holes 420*a* and 420*b* may be provided not to communicate with the refrigerating compartment 21 by being covered by the discharge hole cover 19. For example, the 2*a* discharge hole 420*a* may be covered by the discharge hole cover 19.

Although the drawings illustrate that the plurality of second discharge holes 420 includes the 2*a* discharge holes 420*a* and the 2*b* discharge holes 420*b* arranged in the up-down direction, embodiments are not limited thereto. For example, it is sufficient as long as the plurality of second discharge holes 420 is provided as two or more, and the number of second discharge holes is not limited. For example, the plurality of second discharge holes 420 may be arranged in the left-right direction, and in the case, the second return flow path 430 may also extend in the left-right direction to communicate with each of the plurality of second discharge holes 420.

A combination of the plurality of first return holes 310 shown in FIGS. 18 and 19 and the plurality of second discharge holes 420 shown in FIGS. 20 and 21 is also possible. In addition, as an example, in order to implement the storage compartment 20 as the refrigerating compartment 21 and the freezing compartment 22, at least some of the return holes 310 and 410 and/or the discharge holes 320 and 420 may be opened or closed corresponding to the position of the partition 70. As an example, in order to implement the storage compartment 20 as the refrigerating compartment 21 and the freezing compartment 22, at least some of the return flow paths 330 and 430 and/or the discharge flow paths 340 and 440 may be opened or closed corresponding to the position of the partition 70.

Figure 22:
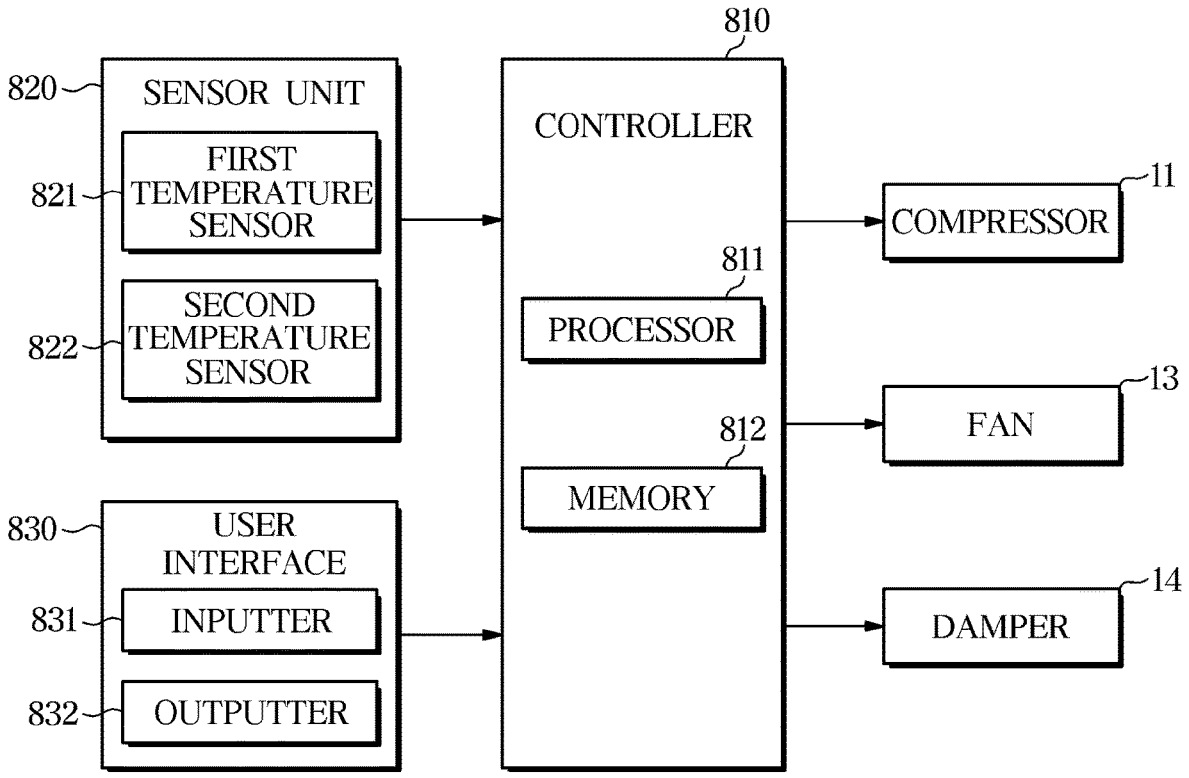
FIG. 22 is a control block diagram of the refrigerator according to an embodiment.

FIG. 22 is a control block diagram of the refrigerator according to an embodiment.

Referring to FIG. 22, the refrigerator 1 may include the controller 810. The refrigerator 1 may include a sensor unit 820. The refrigerator 1 may include a user interface 830. The refrigerator 1 may include the compressor 11. The refrigerator 1 may include the fan 13. The refrigerator 1 may include the damper 14.

Each component of the refrigerator 1 shown in FIG. 22 may be omitted depending on embodiments, and components not shown in FIG. 22 may also be included depending on embodiments.

The controller 810 may control operations of components of the refrigerator 1. For example, the controller 810 may control an operation of the compressor 11. For example, the controller 810 may control an operation of the fan 13. For example, the controller 810 may control the operation of the damper 14. In addition, the controller 810 may control operations of various components of the refrigerator 1.

The controller 810 may include at least one memory 812 storing data in the form of algorithms and/or programs for controlling an operation of the refrigerator 1. The controller 810 may include at least one processor 811 generating control signals related to the operation of the refrigerator 1. The processor 811 may perform the operations of the components of the refrigerator 1 using data stored in the memory 812.

The memory 812 and the processor 811 may be implemented as separate chips. The processor 811 may include one or more processor chips or may include one or more processing cores. The memory 812 may include one or more memory chips or may include one or more memory blocks. Also, the memory 812 and the processor 811 may be implemented as a single chip.

The controller 810 may process a user input received through the user interface 830 and control the components of the refrigerator 1 based on the processing of the user input.

The compressor 11 may be disposed in the machine room 15 provided inside the main body 10. The compressor 11 may compress the refrigerant to high temperature and high pressure. The refrigerant compressed by the compressor 11 may be provided to pass through a condenser. The compressor 11 may operate the cooling cycle of the refrigerator 1.

The fan 13 may be disposed inside the cold air duct 80. The fan 13 may be provided to flow the cold air generated from the evaporator 12. The fan 13 may circulate cold air inside the refrigerator 1.

The damper 14 may be disposed inside the cold air duct 80. The damper 14 may be disposed on the first discharge flow path 340 to open or close the first discharge flow path 340. For example, when the damper 14 opens the first discharge flow path 340, the cold air generated by the evaporator 12 may be supplied to the refrigerating compartment 21 and the freezing compartment 22. For example, when the damper 14 closes the first discharge flow path 340, the cold air generated by the evaporator 12 may be supplied to the freezing compartment 22. That is, as an amount of cold air to be supplied to the refrigerating compartment 21 and/or the freezing compartment 22 is adjusted, the temperature of the refrigerating compartment 21 and the temperature of the freezing compartment 22 may be adjusted.

The user interface 830 may be implemented as a control panel, and may include an inputter 831 for receiving a user input and an outputter 832 for displaying information related to the operation of the refrigerator 1.

For example, the inputter 831 may include at least one of a tact switch, a push switch, a slide switch, a toggle switch, a micro switch, a touch switch, a touch screen, and a button. However, the inputter is not limited thereto and may include various known input devices for receiving user inputs.

For example, the outputter 832 may output information related to the refrigerator 1 through a display or audio. For example, the outputter 832 may include at least one of a liquid crystal display (LCD) panel, a light emitting diode (LED) panel, or a speaker. However, the outputter is not limited thereto and may include various known output devices for displaying information related to the refrigerator 1.

The sensor unit 820 may be provided to detect various states of the refrigerator 1.

The sensor unit 820 may include a first temperature sensor 821 for detecting the temperature of the refrigerating compartment 21. The first temperature sensor 821 may be disposed in the refrigerating compartment 21. For example, the first temperature sensor 821 may be detachably mounted on the front surface of the cold air duct 80 exposed to the refrigerating compartment 21. For example, in the case in which the partition 70 partitions the storage compartment 20 into the refrigerating compartment 21 and the freezing compartment 22 provided below the refrigerating compartment 21, the first temperature sensor 821 may be disposed above the partition 70.

The controller 810 may control the operation of the damper 14 based on information obtained from the first temperature sensor 821. When the first temperature sensor 821 detects a first preset condition, the controller 810 may operate the damper 14 or stop the operation of the damper 14. For example, the controller 810 may control the operation of the damper 14 to open the first discharge flow path 340 based on the temperature of the refrigerating compartment 21 higher than a first set temperature. A detailed description thereof will be given later.

The sensor unit 820 may include a second temperature sensor 822 for detecting the temperature of the freezing compartment 22. The second temperature sensor 822 may be disposed in the freezing compartment 22. For example, the second temperature sensor 822 may be detachably mounted on the front surface of the cold air duct 80 exposed to the freezing compartment 22. For example, in the case in which the partition 70 partitions the storage compartment 20 into the refrigerating compartment 21 and the freezing compartment 22 provided below the refrigerating compartment 21, the second temperature sensor 822 may be disposed below the partition 70.

The controller 810 may control the operation of the damper 14 based on information obtained from the second temperature sensor 822. When the second temperature sensor 822 detects a second preset condition, the controller 810 may operate the damper 14 or stop the operation of the damper 14. For example, the controller 810 may control the operation of the damper 14 to close the first discharge flow path 340 based on the temperature of the freezing compartment 22 higher than a second set temperature. A detailed description thereof will be given later.

Figure 23:
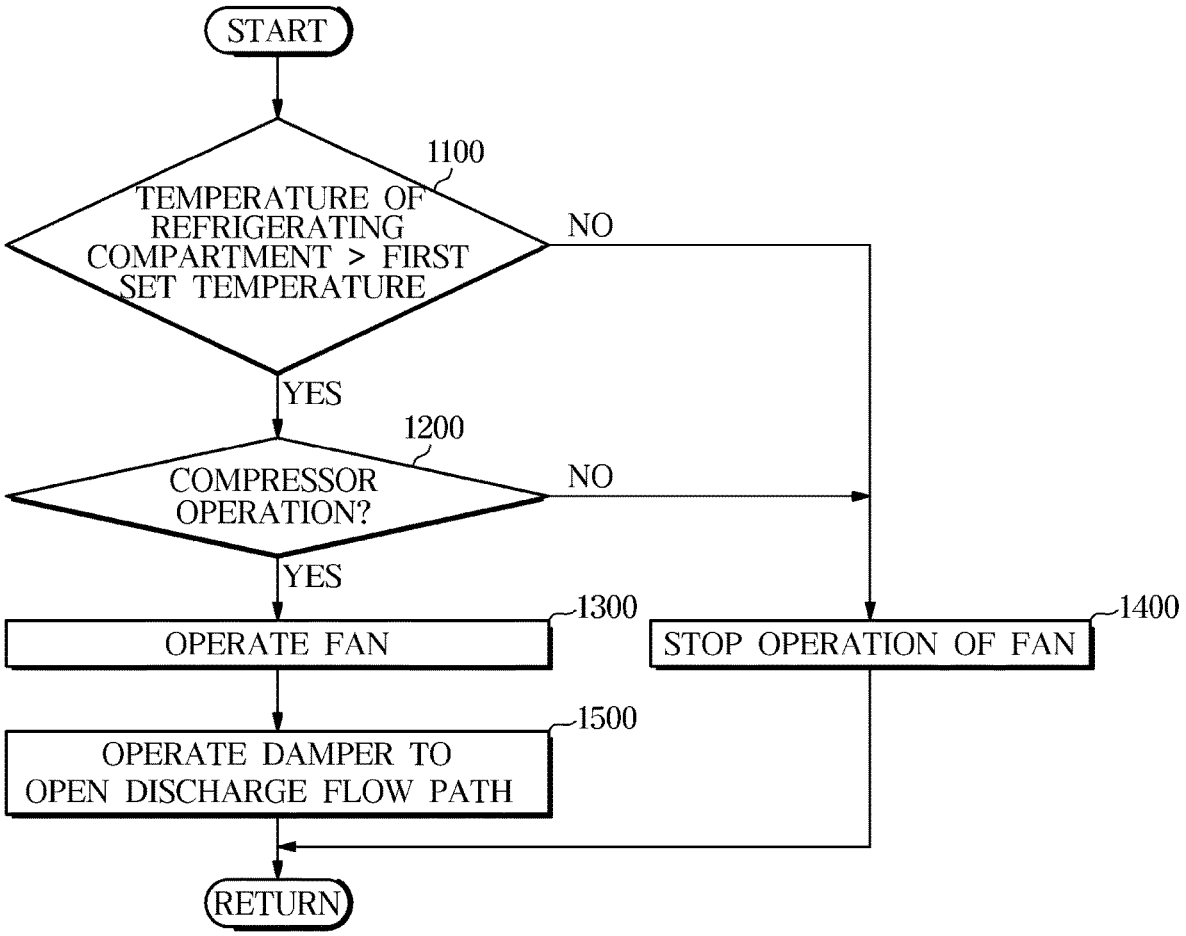
FIG. 23 is a flowchart of a method for controlling the refrigerator according to an embodiment.

FIG. 23 is a flowchart of a method for controlling the refrigerator according to an embodiment.

When the temperature of the refrigerating compartment 21 is higher than the first set temperature (YES in 1100), it may be determined whether the compressor 11 is operating (1200). For example, the controller 810 may determine whether the compressor 11 is operating based on the temperature of the refrigerating compartment 21 higher than the first set temperature. For example, the temperature of the refrigerating compartment 21 may be measured by the first temperature sensor 821. For example, the controller 810 may be configured to compare a value received from the first temperature sensor 821 with the first set temperature.

When the temperature of the refrigerating compartment 21 is not higher than the first set temperature (NO in 1100), the operation of the fan 13 may be stopped (1400). For example, the controller 810 may stop the operation of the fan 13 based on the temperature of the refrigerating compartment 21 not higher than the first set temperature.

When the compressor 11 is operated (YES in 1200), the fan 13 may be operated (1300). For example, the controller 810 may operate the fan 13 based on operating of the compressor 11. That is, the fan 13 may be operated after the compressor 11 is operated first.

When the compressor 11 is not operated (NO in 1200), the operation of the fan 13 may be stopped (1400). For example, the controller 810 may stop the operation of the fan 13 based on not operating of the compressor 11. That is, the fan 13 may not be operated until the compressor 11 is operated.

When the fan 13 is operated (1300), the damper 14 may be operated to open the first discharge flow path 340 (1500). For example, the controller 810 may control the operation of the damper 14 to open the first discharge flow path 340 based on the operation of the fan 13.

For example, when the temperature of the refrigerating compartment 21 is higher than the first set temperature (YES in 1100) and the compressor 11 is operated (YES in 1200), the fan 13 may be operated to flow cold air inside the cold air duct 80 (1300), and the damper 14 may open the first discharge flow path 340 in order to supply cold air flowing by the fan 13 to the refrigerating compartment 21. Therefore, the cold air generated by the evaporator 12 may be discharged to the refrigerating compartment 21 via the first discharge flow path 340. As a result, the temperature of the refrigerating compartment 21 may be lowered. Accordingly, when the temperature of the refrigerating compartment 21 is equal to or lower than the first set temperature (NO in 1100 after return), the operation of the fan 13 may be stopped.

The flowchart shown in FIG. 23 is not intended to limit the order of each of the steps 1100, 1200, 1300, 1400, and 1500, and the order of each of the steps 1100, 1200, 1300, 1400, and 1500 may be changed depending on various embodiments. For example, the determining whether the compressor is operating (1200) may be performed prior to the determining whether the temperature of the refrigerating compartment 21 is higher than the first set temperature (1100).

Figure 24:
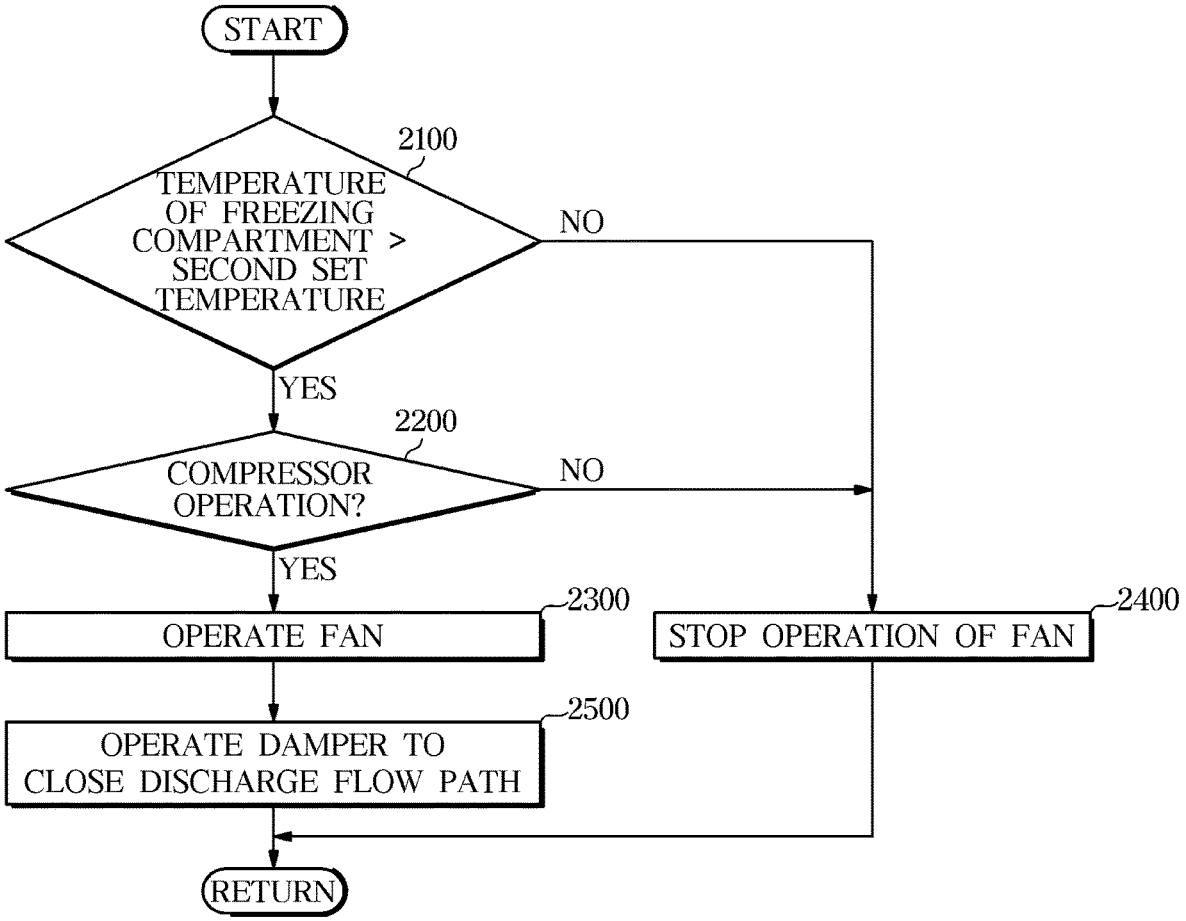
FIG. 24 is a flowchart of a method for controlling the refrigerator according to another embodiment.

FIG. 24 is a flowchart of a method for controlling the refrigerator according to another embodiment.

When the temperature of the freezing compartment 22 is higher than the second set temperature (YES in 2100), it is determined whether the compressor 11 is operating (2200). For example, the controller 810 may determine whether the compressor 11 is operating based on the temperature of the freezing compartment 22 higher than the second set temperature. For example, the temperature of the freezing compartment 22 may be measured by the second temperature sensor 822. For example, the controller 810 may be configured to compare a value received from the second temperature sensor 822 with the second set temperature.

When the temperature of the freezing compartment 22 is not higher than the second set temperature (NO in 2100), the operation of the fan 13 may be stopped (2400). For example, the controller 810 may stop the operation of the fan 13 based on the temperature of the freezing compartment 22 not higher than the second set temperature.

When the compressor 11 is operated (YES in 2200), the fan 13 may be operated (2300). For example, the controller 810 may operate the fan 13 based on operating of the compressor 11. That is, the fan 13 may be operated after the compressor 11 is operated first.

When the compressor 11 is not operated (NO in 2200), the operation of the fan 13 may be stopped (2400). For example, the controller 810 may stop the operation of the fan 13 based on not operating of the compressor 11. That is, the fan 13 may not be operated until the compressor 11 is operated.

When the fan 13 is operated (2300), the damper 14 may be operated to close the first discharge flow path 340 (2500). For example, the controller 810 may control the operation of the damper 14 to close the first discharge flow path 340 based on operating of the fan 13.

For example, when the temperature of the freezing compartment 22 is higher than the second set temperature (YES in 2100) and the compressor 11 is operated (YES in 2200), the fan 13 may be operated to flow cold air inside the cold air duct 80 (2300), and the damper 14 may close the first discharge flow path 340 in order to intensively supply cold air flowing by the fan 13 to the freezing compartment 22. Therefore, the cold air generated by the evaporator 12 may be discharged to the freezing compartment 22 via the second discharge flow path 440. As a result, the temperature of the freezing compartment 22 may be lowered. Accordingly, when the temperature of the freezing compartment 22 is equal to or lower than the second set temperature (NO in 2100 after return), the operation of the fan 13 may be stopped.

The flowchart shown in FIG. 24 is not intended to limit the order of each of the steps 2100, 2200, 2300, 2400, and 2500, and the order of each of the steps 2100, 2200, 2300, 2400, and 2500 may be changed depending on various embodiments. For example, the determining whether the compressor is operating (2200) may be performed prior to the determining whether the temperature of the freezing compartment 22 is higher than the second set temperature (2100).

When the temperature of the refrigerating compartment 21 is higher than the first set temperature and the temperature of the freezing compartment 22 is higher than the second set temperature, it is determined whether the compressor 11 is operating, and the operations of the fan 13 and the damper 14 may be controlled.

For example, when the compressor 11 is not operated, the fan 13 may not be operated. That is, the fan 13 may not be operated until the compressor 11 is operated.

For example, when the compressor 11 is operated, the fan 13 may be operated in order to flow cold air inside the cold air duct 80, and the damper 14 may be operated to close the first discharge flow path 340 after opening the first discharge flow path 340 for a predetermined time. The controller 810 may output a signal so that the damper 14 opens or closes the first discharge flow path 340.

For example, the damper 14 may be operated to open the first discharge flow path 340 based on operating of the compressor 11 and operating of the fan 13. A part of the cold air generated from the evaporator 12 may be supplied to the refrigerating compartment 21 along the first discharge flow path 340. The other part of the cold air generated from the evaporator 12 may be supplied to the freezing compartment 22 along the second discharge flow path 440. Accordingly, the temperatures of the refrigerating compartment 21 and the freezing compartment 22 may be lowered overall. When the temperature of the refrigerating compartment 21 is equal to or lower than the first set temperature, the damper 14 may be operated to close the first discharge flow path 340. All of the cold air generated from the evaporator 12 may be supplied to the freezing compartment 22 along the second discharge flow path 440. As a result, the damper 14 may be operated to satisfy the temperature of the freezing compartment 22 after satisfying the temperature of the refrigerating compartment 21.

The foregoing has illustrated and described specific embodiments. However, it should be understood by those of skilled in the art that embodiments are not limited to the above-described embodiments, and various changes and modifications may be made without departing from the technical idea described in the following claims.

What is claimed is:

1. A refrigerator comprising:

an outer case;

an inner case;

an evaporator;

a partition detachably mounted inside the inner case to define a refrigerating compartment and a freezing compartment below the refrigerating compartment;

a cold air duct at a rear of the partition, the cold air duct being configured to guide cold air inside the inner case and comprising a front body facing inside the inner case and a rear body formed at a rear of the front body; and a cold air connector connected to the cold air duct from an outside of the inner case, the cold air connector being configured to deliver the cold air inside the refrigerating compartment to the evaporator, wherein the cold air duct comprises:

a first discharge hole communicating with the refrigerating compartment to supply the cold air cooled by the evaporator to the refrigerating compartment, a second discharge hole communicating with the freezing compartment to supply the cold air cooled by the evaporator to the freezing compartment, a first return hole formed in the front body of the cold air duct, positioned below the first discharge hole and communicating with the refrigerating compartment to return the cold air inside the refrigerating compartment, a communication hole formed in the rear body of the cold air duct and positioned above the first return hole, and a return flow path extending from the refrigerating compartment to the cold air connector and configured to guide the cold air inside the refrigerating compartment to the cold air connector, the return flow path having a first side configured to receive the cold air returned from the refrigerating compartment and a second side configured to supply the returned cold air to the cold air connector, and wherein the return flow path is configured to communicate with an outside of the cold air duct through the communication hole and extend upward from the first return hole to the communication hole.

2. The refrigerator according to claim 1, wherein the cold air duct further comprises:

a discharge flow path configured to guide the cold air cooled by the evaporator to the first discharge hole; and a wall separating the return flow path and the discharge flow path.

3. The refrigerator according to claim 1, wherein, when the partition is separated from the inner case, the inside of the inner case defines the refrigerating compartment or the freezing compartment.

4. The refrigerator according to claim 1, wherein the cold air duct further comprises a second return hole communicating with the freezing compartment to return the cold air inside the freezing compartment, the second return hole being positioned below the second discharge hole.

5. The refrigerator according to claim 4, wherein the return flow path is a first return flow path, and wherein the cold air duct forms a second return flow path configured to guide the cold air returned through the second return hole to the evaporator.

6. The refrigerator according to claim 4, wherein the partition is between the first return hole and the second discharge hole.

7. The refrigerator according to claim 4, wherein the partition is configured to be movable between the first return hole and the second discharge hole.

8. The refrigerator according to claim 1, wherein the cold air duct extends along a height direction of the inner case, wherein a first portion of the cold air duct corresponds to the refrigerating compartment, and wherein a second portion of the cold air duct corresponds to the freezing compartment.

9. The refrigerator according to claim 1, wherein the cold air duct is configured to divide the inside of the inner case into (i) a storage space in which the refrigerating compartment and the freezing compartment are formed and (ii) a cold air generating space in which the evaporator is provided, and wherein the cold air generating space is provided at a rear of at least a part of the storage space.

10. The refrigerator according to claim 1, wherein the rear body is configured to face a rear surface of the inner case, and the front body is coupled to a front of the rear body, the front body being configured to be exposed toward the refrigerating compartment and the freezing compartment, and wherein the partition is detachably mounted on a front surface of the front body.

11. The refrigerator according to claim 10, wherein the cold air duct further comprises a support member between the front body and the rear body, the support member being configured to form the return flow path.

12. The refrigerator according to claim 1, further comprising:

a door configured to open and close the refrigerating compartment and the freezing compartment together.

13. The refrigerator according to claim 1, wherein the refrigerator further comprises an insulator between the inner case and the outer case, and wherein the cold air connector is configured to be embedded in the insulator.

14. The refrigerator according to claim 1, wherein the cold air duct further comprises:

a first discharge flow path configured to guide the cold air cooled by the evaporator to the first discharge hole; and a second discharge flow path configured to guide the cold air cooled by the evaporator to the second discharge hole.

15. The refrigerator according to claim 14, further comprising:

a fan configured to draw the cold air cooled by the evaporator and discharge the drawn cold air into the first discharge flow path and the second discharge flow path;

a damper configured to open and close the first discharge flow path;

a first temperature sensor configured to detect a temperature of the refrigerating compartment;

a second temperature sensor configured to detect a temperature of the freezing compartment; and a controller configured to control the damper to open or close the first discharge flow path based on information obtained from at least one of the first temperature sensor or the second temperature sensor.

16. A refrigerator comprising:

a main body forming a storage compartment;

an evaporator in the storage compartment;

a partition configured to divide the storage compartment into a refrigerating compartment and a freezing compartment that is positioned below the refrigerating compartment, the partition being provided in front of the evaporator; and a cold air duct extending between the evaporator and the partition along a height direction of the storage compartment, the cold air duct being configured to supply cold air cooled from the evaporator to the refrigerating compartment and the freezing compartment and comprising a front body facing inside the storage compartment and a rear body formed at a rear of the front body, wherein the cold air duct further comprises:

a first return hole communicating with the refrigerating compartment to return the cold air in the refrigerating compartment, a communication hole formed in the rear body of the cold air duct and positioned above the first return hole, a first return flow path having a shape extending rearward from the first return hole to guide the cold air introduced through the first return hole to the evaporator, a second return hole communicating with the freezing compartment to return the cold air in the freezing compartment, and a second return flow path having a shape extending rearward from the second return hole to guide the cold air introduced through the second return hole to the evaporator, wherein the first return flow path is configured to communicate with an outside of the cold air duct through the communication hole and extend upward from the first return hole to the communication hole.

17. The refrigerator according to claim 16, wherein the partition is detachably mounted to a front of the cold air duct.

18. The refrigerator according to claim 16, wherein the refrigerator further comprises a fan in the cold air duct that is configured to generate a blowing force, wherein the cold air duct further comprises:

a discharge flow path extending from a discharge side of the fan to the refrigerating compartment to guide the cold air cooled from the evaporator to the refrigerating compartment, and a wall formed between the first return flow path and the discharge flow path to divide the first return flow path and the discharge flow path.

19. The refrigerator according to claim 18, wherein the discharge flow path is a first discharge flow path, and wherein the cold air duct further comprises a second discharge flow path extending from the discharge side of the fan to the freezing compartment to guide the cold air cooled from the evaporator to the freezing compartment.

20. A refrigerator comprising:

a main body forming a storage compartment;

an evaporator in the storage compartment;

a partition configured to divide the storage compartment into a refrigerating compartment and a freezing compartment that is positioned below the refrigerating compartment, the partition being provided in front of the evaporator; and a cold air duct extending between the evaporator and the partition along a height direction of the storage compartment, the cold air duct being configured to supply cold air cooled from the evaporator to the refrigerating compartment and the freezing compartment, wherein the cold air duct is provided to form:

a first return hole communicating with the refrigerating compartment to return the cold air in the refrigerating compartment, a first return flow path having a shape extending rearward from the first return hole to guide the cold air introduced through the first return hole to the evaporator, a second return hole communicating with the freezing compartment to return the cold air in the freezing compartment, and a second return flow path having a shape extending rearward from the second return hole to guide the cold air introduced through the second return hole to the evaporator, wherein the first return hole is a plurality of first return holes arranged along the height direction of the storage compartment, wherein the partition is movable along the height direction of the storage compartment, wherein the partition is configured to be positioned below at least one of the plurality of first return holes, and wherein the refrigerator further comprises a return hole cover configured to cover a return hole of the plurality of first return holes that is positioned below the partition.

* * * * *